US005759651A

United States Patent [19]

Machii et al.

[11] Patent Number: 5,759,651

[45] Date of Patent: Jun. 2, 1998

[54] SEAMLESS CAN

[75] Inventors: Sachiko Machii; Tetsuo Miyazawa; Kenichirou Nakamaki; Katsuhiro Imazu, all of Kanagawa, Japan

[73] Assignee: Toyo Seikan Kaisha, Ltd., Tokyo, Japan

[21] Appl. No.: 613,197

[22] Filed: Mar. 6, 1996

[30] Foreign Application Priority Data

Mar. 7, 1995 [JP] Japan ..... 7-047333

[51] Int. Cl.[6] ..... B32B 15/08

[52] U.S. Cl. ..... 428/35.8; 428/458; 428/480; 413/5; 413/18; 220/415; 220/906

[58] Field of Search ..... 428/35.8, 480, 428/483, 458; 413/5, 18; 220/415, 906

[56] References Cited

FOREIGN PATENT DOCUMENTS

A0182646 5/1986 European Pat. Off. .

A0544545 6/1993 European Pat. Off. .

A4029553 3/1991 Germany .

2279905 1/1995 United Kingdom .

*Primary Examiner*—Charles Nold

*Attorney, Agent, or Firm*—Sughrue, Mion, Zinn, Macpeak & Seas, PLLC

[57] ABSTRACT

A thin-walled, deep-draw-ironed seamless can comprising a laminate of a metal sheet and a biaxially stretched film of polyester or copolyester mainly comprising an ethylene terephthalate unit. The thickness of the side wall portion of the can is reduced to from 30 to 85% of the original thickness of the laminate. The film layer on the side wall portion of the can has a parallel component orientation (D1) defined by formula (1) of 65% or more and a half width (Wh) of the peak at an angle of diffraction 2θ of from 14° to 20° falling within 1.8°.

18 Claims, 16 Drawing Sheets

SEAMLESS CAN

FIELD OF THE INVENTION

The present invention relates to a seamless can comprising a laminate of a metal sheet and a biaxially oriented film of polyester or copolyester. More specifically, the present invention relates to a seamless can which concurrently exhibits excellent shock resistance (dent resistance), corrosion resistance and double seaming and sealing properties.

BACKGROUND OF THE INVENTION

A side seamless can is produced, according to a conventional method, by subjecting a metal blank such as an aluminum plate, a tin plate or a tin-free steel plate, to at least one drawing stage. The drawing stage is conducted between a drawing die and a punch to form a cup comprising a barrel portion free of seams on the side surface thereof and a bottom portion integrally connected to the barrel portion which is also free of seams. Then, if desired, the barrel portion may be subjected to ironing between an ironing punch and a die to reduce the thickness of the barrel portion of the container. It is also known in the art to reduce the thickness of the side wall by bending and elongating the side wall at a curvature corner part of the redrawing die as described, for example, in JP-B-56-501442 (the term "JP-B" as used herein means an "examined Japanese patent publication").

Methods for coating an organic film onto the side seamless can include a method of applying an organic paint onto a formed can which is a common and widely used technique and, in addition, a method of laminating a resin film onto a metal blank before a can is formed. Furthermore, JP-B-59-34580 describes a product obtained by laminating a polyester film derived from terephthalic acid and tetramethylene glycol onto a metal blank. Also, in the production of a can redrawn by bend-elongation, it is known to use a metal sheet coated with a vinyl organosol, epoxy, phenolic, polyester or acryl.

Many proposals have been made with respect to the production of a polyester-coated metal sheet. For example, JP-A-51-4229 (the term "JP-A" as used herein means an "unexamined published Japanese patent application") describes a coating film comprising polyethylene terephthalate which retains a biaxial orientation on the surface thereof, and JP-A-6-172556 proposes the use of a polyester film having a limiting viscosity ($\eta$) of 0.75 or more in the metal laminate.

Furthermore, JP-A-3-101930 describes a coated metal sheet for drawn cans comprising a laminate of a metal sheet, a polyester film layer mainly consisting of an ethylene terephthalate unit and, if desired, an adhesion primer layer interposed between the metal sheet and the polyester film. The polyester film layer has an X-ray diffraction intensity defined by the following formula of from 0.1 to 15:

$$Rx=IA/IB$$

wherein IA represents an X-ray diffraction intensity on the diffraction surface placed in parallel with the polyester film surface at a spacing of about 0.34 nm (the angle of diffraction by CuK$\alpha$ X rays is from 24° to 28°) and IB represents an X-ray diffraction intensity on the diffraction surface placed in parallel with the polyester film at a spacing of about 0.39 nm (the angle of diffraction by CuK$\alpha$ X rays is from 21.5° to 24°), and the anisotropy index in the in-plane orientation of a crystal is 30 or less. This patent publication also describes a thin-walled drawn can obtained by subjecting the above-described coated metal sheet to drawing-redrawing formation including bending and elongating the side wall portion of the can barrel in the redrawing step to reduce the wall thickness.

The above-described conventional techniques are advantageous in that a resin film is applied onto a metal blank before a can is formed. This dispenses with the need for a baking furnace for the coating film or a facility for processing the exhaust gas of coatings that is usually required in a coating process. Also, this technique causes no air pollution and further can dispense with the need for spray coating after a can is formed. However, much improvement is still desired with respect to various can properties, especially shock resistance (dent resistance), corrosion resistance and double seaming and sealing properties.

JP-A-3-101930 proposes to provide an oriented crystal in constant balance to the polyester film layer of a coated metal blank for drawing/redrawing to thereby provide excellent workability and corrosion resistance (pinhole resistance). However, this technique is still insufficient in terms of shock resistance and corrosion resistance against corrosive can contents.

As a practical matter, the shock resistance that is required in canned products includes dent resistance. The dent resistance property is such that even when canned products fall or colloid with each other to form a recession or scar on the canned product, the adhesion and integrity of the coating is completely maintained. More specifically, when the coating is peeled off or pinholes or cracks develop in the coating in a denting test, a problem arises in that metal may elute into the contents of the can, or leakage due to corrosion may result to thereby spoil the contents of the can.

Also, a can for canned products must be able to tolerate heat treatment. That is, a print indicating the contents is usually applied to the outer surface of the can, and the heating step for printing the ink adversely affects the polyester film. The polyester tends to crystallize (i.e., becomes brittle) due to the heating step. This in turn impairs the dent resistance and adhesion to the metal substrate, and also deteriorates the coating property or workability upon subsequent neck-in or double-seam processing.

In view of the above, it is considered that various properties of a metal can coated with polyester film, particularly shock resistance (dent resistance), corrosion resistance and double seaming and sealing properties do not depend on the physical properties of the polyester film prior to or after coating on the metal sheet, but rather depend on the physical properties of the film on the metal sheet that is actually formed into a can.

Furthermore, in the case of a seamless can formed from a coated metal sheet, it is also very important to considerably reduce the thickness of the side wall portion of the can barrel in order to reduce the cost for materials and decrease the container weight. In the redrawing step, a method where the side wall portion is bent and elongated (bending-bending back deformation) at the corner part of a die having a small radius R to thereby reduce the wall thickness is successful to a certain degree in reducing the material cost and decreasing the container weight. This method comprises reducing the thickness of the side wall portion of a seamless can and at the same time, making the thickness uniform and increasing the can height. However, the reduction in thickness by bend-elongation is naturally limited, and has also been found to adversely affect the orientation properties of polyester. In other words, a seamless can comprising polyester oriented by bend-elongation still has insufficient dent resistance after heat treatment.

The present inventors have found that in drawing/redrawing a polyester coated metal sheet, if the side wall portion of the can barrel is subjected to bend-elongation and also to ironing under specific conditions, the molecular orientation of the polyester film on the side wall portion is advantageously modified. As a result, the shock resistance (dent resistance), corrosion resistance and double seaming and sealing properties after the polyester is subjected to heat treatment are remarkably improved. At the same time, a reduction in material cost and a decrease in container weight is achieved.

SUMMARY OF THE INVENTION

An object of the present invention is to provide a coated metal seamless can comprising a polyester film layer having a specific molecular orientation which provides a remarkable improvement in shock resistance (dent resistance), corrosion resistance and double seaming and sealing properties after the polyester is subjected to heat treatment, and also provides a reduction in material cost and a decrease in container weight.

The above object of the present invention has been achieved by providing a seamless can comprising a laminate of a metal sheet and a biaxially stretched film of polyester or copolyester mainly comprising an ethylene terephthalate unit, wherein the thickness of the side wall portion of the can has been reduced to from 30 to 85% of the original thickness of the laminate, and the film layer on the side wall portion of the can has a parallel component orientation (D1) defined by the following formula (1) of 65% or more and a half width (Wh) of the peak at a diffraction angle 2θ of approximately from 14° to 20° falling with in 1.8°;

$$D1 = \frac{B}{A} \times 100 \quad (1)$$

wherein A represents a peak intensity at 2θ of approximately from 24° to 29° in a corrected X-ray diffraction curve which is obtained by peeling a plurality of films from the side wall portion of a can, superposing the films in parallel with one another in the height direction of the can, applying an X ray (Cu-Kα) to enter the film surface perpendicular to the height direction of the can, varying the angle of diffraction (2θ) within the surface including the incident X ray and perpendicular to said height direction to obtain an X-ray diffraction curve and, in the X-ray diffraction curve thus obtained, drawing a base line connecting troughs and feet between peaks in the range of 2θ of from 10° to 60° to obtain a corrected X-ray diffraction curve; and B represents an intensity from the base line in the range of 2θ of approximately from 14° to 20° in the corrected X-ray diffraction curve.

According to a preferred embodiment of the present invention, in the polyester film on the side wall portion of the can barrel having a front surface side and a metal sheet side, the birefringence (Δn) determined by a birefringence method and defined by the following formula (2) is from 0.020 to 0.180 on the front surface side ($\Delta n_1$) and from 0.005 to 0.100 on the side in contact with the metal sheet ($\Delta n_4$), at least two or more birefringence peaks are present along the thickness direction from the front surface to the metal sheet side, a birefringence peak ($P_1$)($\Delta n_2$) is present in the vicinity of front surface side and a birefringence peak ($P_2$)($\Delta n_3$) is present in the vicinity of the metal sheet side, the birefringence peak ($P_1$)($\Delta n_2$) in the vicinity of the front surface side is from 0.020 to 0.220 and at least 0.005 higher than the birefringence of the higher side of the foot of the peak, and the birefringence peak ($P_2$)($\Delta n_3$) in the vicinity of the metal sheet side is from 0.010 to 0.200 and at least 0.005 higher than the birefringence of the higher side of the foot of the peak:

$$\Delta n_{1-4} = n_h - n_t \quad (2)$$

wherein $n_h$ is a refractive index of the film in the lengthwise direction of the can, that is, in the direction of maximum orientation of the film, and $n_t$ is a refractive index in the thickness direction of the film.

DETAILED DESCRIPTION OF THE INVENTION

Figure 1:
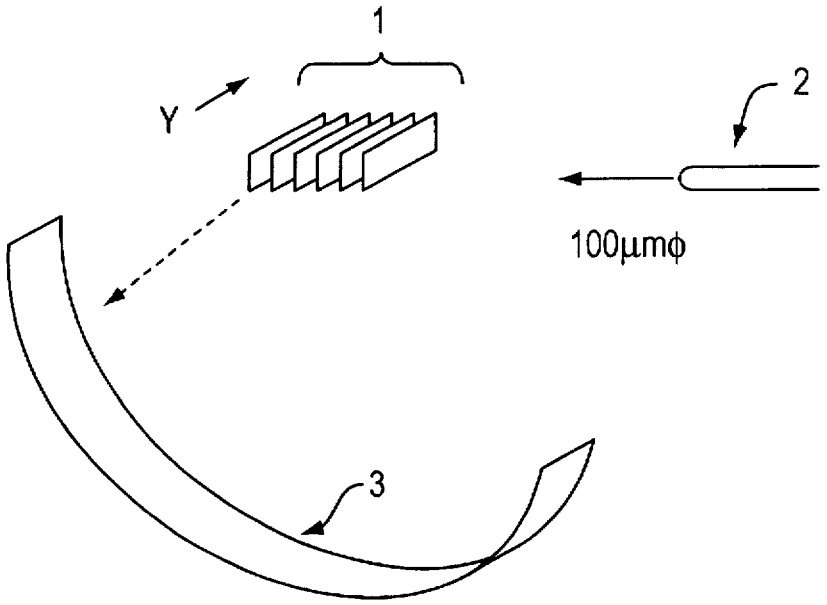
FIG. 1 is a schematic view of a micro X-ray diffractometry as carried out in the experimental Examples.

The seamless can of the present invention comprises a laminate of a metal sheet and a biaxially stretched film of polyester or copolyester mainly comprising an ethylene terephthalate unit. The seamless can is further characterized in that the thickness on the side wall portion of the can is reduced to from 30 to 85% of the original thickness of the laminate, and the film layer on the side wall portion of the can has a parallel component orientation (D1) defined by the following formula (1) of 65% or more and a half width (Wh) of the peak at a diffraction angle 2θ of approximately from 14° to 20° falling within 1.8°, preferably 1.4°:

$$D1 = \frac{B}{A} \times 100 \quad (1)$$

wherein A represents a peak intensity at 2θ of approximately from 24° to 29° in a corrected X-ray diffraction curve which is obtained by peeling a plurality of films from the side wall portion of a can, superposing the films in parallel with one another in the height direction of the can, applying an X ray (Cu-Kα) to enter the film surface perpendicular to the can height direction, varying the angle of diffraction (2θ) within the surface including the incident X ray and perpendicular to the height direction to obtain an X-ray diffraction curve and, in the X-ray diffraction curve thus obtained, drawing a base line connecting troughs and feet between peaks in the range of 2θ of approximately from 10° to 60° to obtain a corrected X-ray diffraction curve; and B represents an intensity from the base line in the range of 2θ of approximately from 14° to 20° in the corrected X-ray diffraction curve.

In the present invention, the polyester on the side wall portion of the can barrel has a parallel component orientation (D1) of 65% or more, preferably 75% or more, and a half value (Wh) of the peak at 2θ of approximately from 14° to 20° falling within 1.8°, preferably within 1.4°. The seamless can of the invention having the above defined characteristics exhibits remarkably enhanced shock resistance (dent resistance), corrosion resistance and double seaming and sealing properties after heat treatment.

The following description refers to the Examples below. More particularly, when a seamless can is formed from a laminate of a metal sheet and a biaxially stretched polyester film which, in the drawing/redrawing step, is only subjected to bend-elongation of the side wall portion of the can barrel, the parallel component orientation (D1) is less than 65% even though the thickness of the side wall portion of the can is reduced to 80% of the original thickness of the laminate. The resulting can has a poor denting property in the vicinity of the neck portion, and tends to exhibit a corrosion defect at the dented part (Example 8). When a seamless can is formed from a laminate of a metal sheet and a polyester film, which, in the drawing/redrawing step, is subjected to bend-elongation and at the same time, ironing of the side wall portion of the can barrel, the half width of the peak at 2θ of from 14° to 20° exceeds 1.8° even though the thickness of the side wall portion of the can is reduced to 65% of the original thickness of the laminate. The resulting can has a poor denting property in the vicinity of the neck portion, and tends to exhibit a corrosion defect at the dented part (Example 9). On the other hand, when a seamless can is formed from a laminate of a metal sheet and a biaxially stretched polyester film which, in the drawing/redrawing working step, is subjected to bend-elongation and ironing under specific conditions (described below) of the side wall portion of the can barrel, and despite the fact that the thickness of the side wall portion of the can is reduced to from 30 to 85% of the original thickness of the laminate, the parallel component orientation (D1) of the film is 65% or more and the half width of the peak at 2θ of from 14° to 20° falls within 1.8°. The resulting can has a good denting property in the vicinity of the neck portion, and concurrently exhibits excellent shock resistance (dent resistance), corrosion resistance, and double seaming and sealing properties (Example 1 and other Examples).

The X-ray diffraction method used for measuring the parallel component orientation (D1) and the half width (Wh) in the present invention is quite different from the usual X-ray diffraction method, and the value determined according this measuring method is explained below.

In FIG. 1 which explains the X-ray diffraction method for use in the present invention, a plurality (six) of film samples 1 are peeled off from the side wall portion of a can and superposed in parallel with each other in the can height direction Y (the direction of the hatched arrow). An X ray beam 2 (Cu-Kα) is applied to enter the film surface perpendicular to the can height direction, the angle of diffraction (2θ) is varied within the surface including the incident X ray and perpendicular to the can height direction, and the intensity of diffracted X rays is measured by a detector 3 or PSPC (position sensitive pulse counter).

On the other hand, the crystal structure of polyethylene terephthalate comprises a triclinic system having the following lattice constants:

a=4.56 Å
b=5.94 Å
c=10.75 Å
α=98.5°
β=118°
γ=112°

Figure 2A:
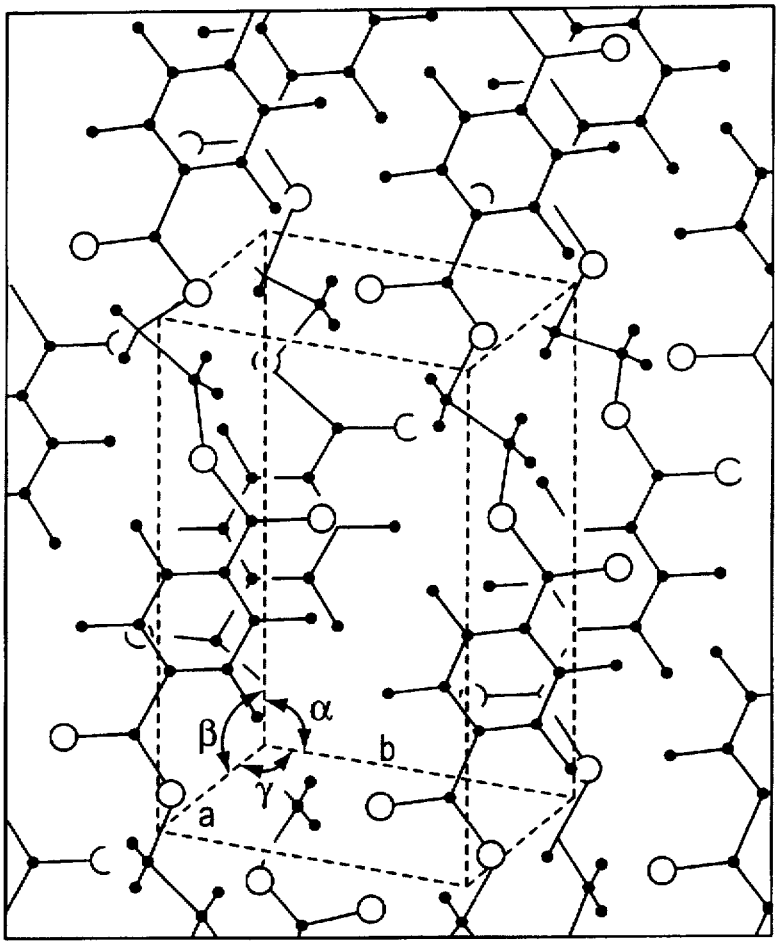
FIGS. 2(*a*) and 2(*b*) are views showing the atomic arrangement in a crystal unit lattice of polyethylene terephthalate.
Figure 2B:
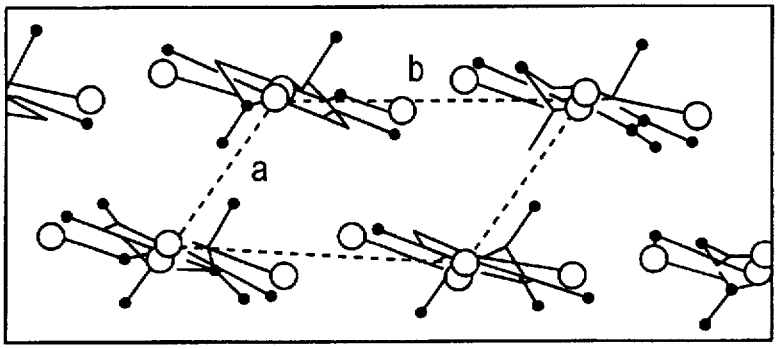

In FIGS. 2(*a*) and 2(*b*) which show the atomic arrangement in the crystal unit lattice of polyethylene terephthalate, the molecular chain of polyethylene terephthalate extends in the direction of the C axis and, at the same time, is positioned on each side line in the C axis direction. The face including the benzene ring is almost parallel to the face having an index (100).

Along each face (h k l), spacing d(h k l) and diffraction angle 2θ of the crystal unit lattice, the relationship shown Table 1 below is present.

TABLE 1

| (h, k, l) | d (h, k, l) (Å) | 2θ (°) |
|---|---|---|
| (0–11) | 5.41 | 16.4 |
| (010) | 5.06 | 17.5 |
| (−111) | 4.18 | 21.3 |
| (1–10) | 3.95 | 22.5 |
| (100) | 3.46 | 25.8 |
| (1–11) | 3.21 | 27.8 |
| (101) | 2.73 | 32.8 |
| (111) | 2.35 | 38.3 |
| (10–5) | 2.11 | 42.9 |

Figure 3:
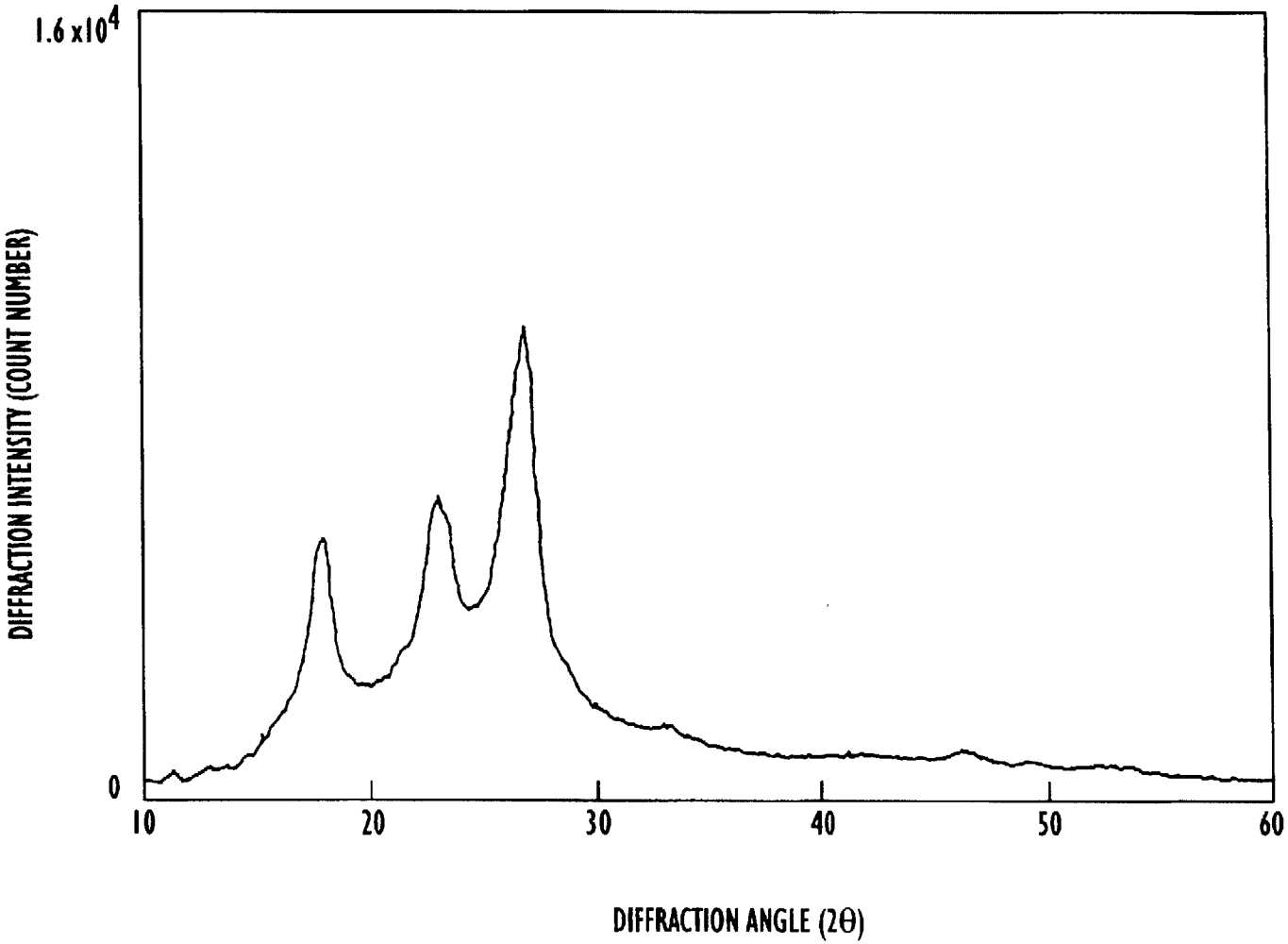
FIG. 3 is a view showing an X-ray diffraction chart of a film layer on the side wall portion of a seamless can obtained by a conventional bend-elongation method (Example 8)
Figure 4:
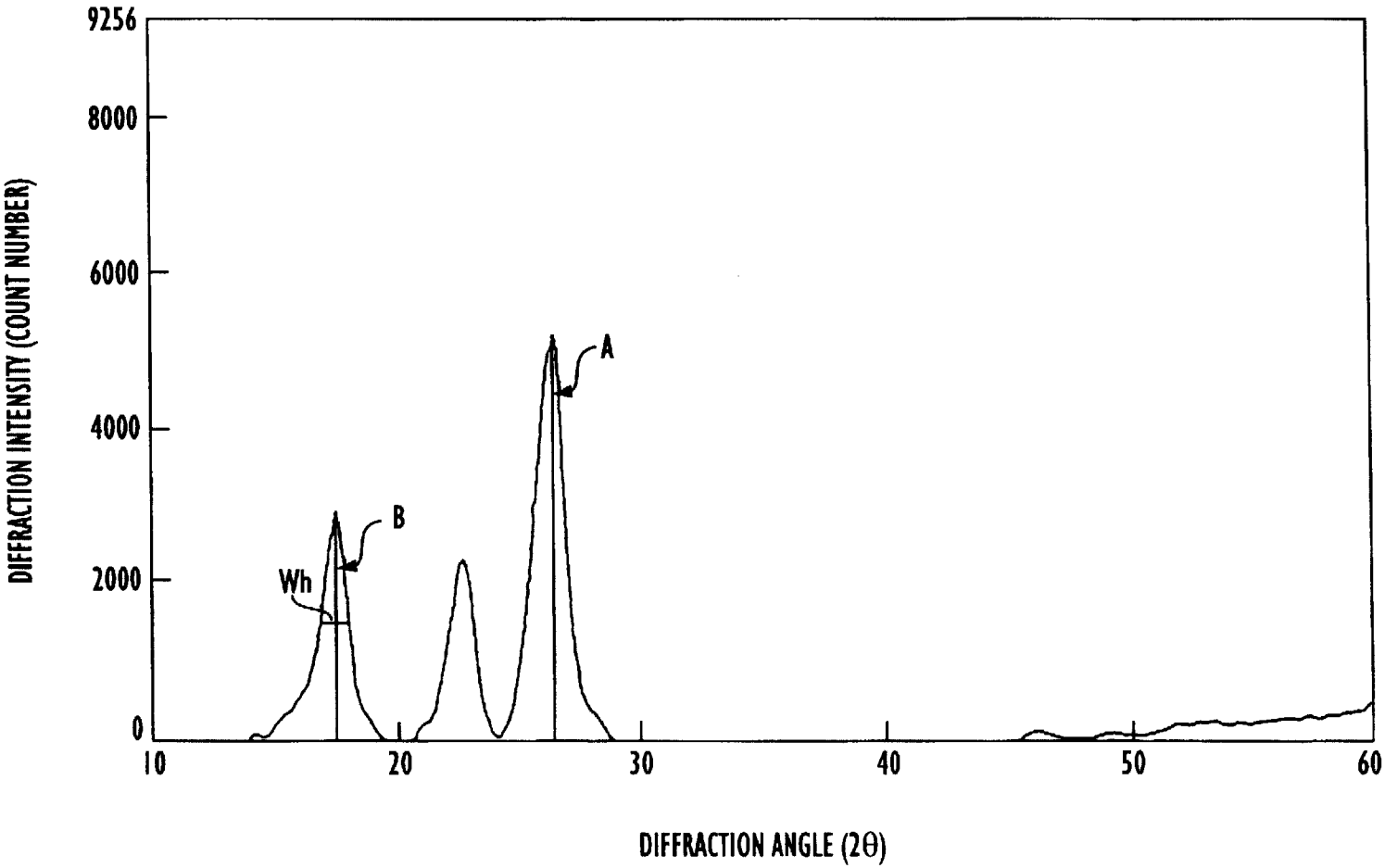
FIG. 4 is a view showing an X-ray diffraction chart after base-line correction of a film layer on the side wall portion of a seamless can obtained by a conventional bend-elongation method (Example 8)

FIG. 3 shows an X-ray diffraction curve obtained when the X-ray diffraction method described in FIG. 1 is applied to the polyester film layer on the side wall portion of a seamless can produced according to a conventional bend-elongation method. FIG. 4 shows a corrected X-ray diffraction curve obtained by drawing a base line connecting the troughs and feet between peaks in the range of 2θ of from 10° to 60° in the X-ray diffraction curve of FIG. 3. FIG. 4 shows Wh, peak intensity B and peak intensity A.

Figure 5:
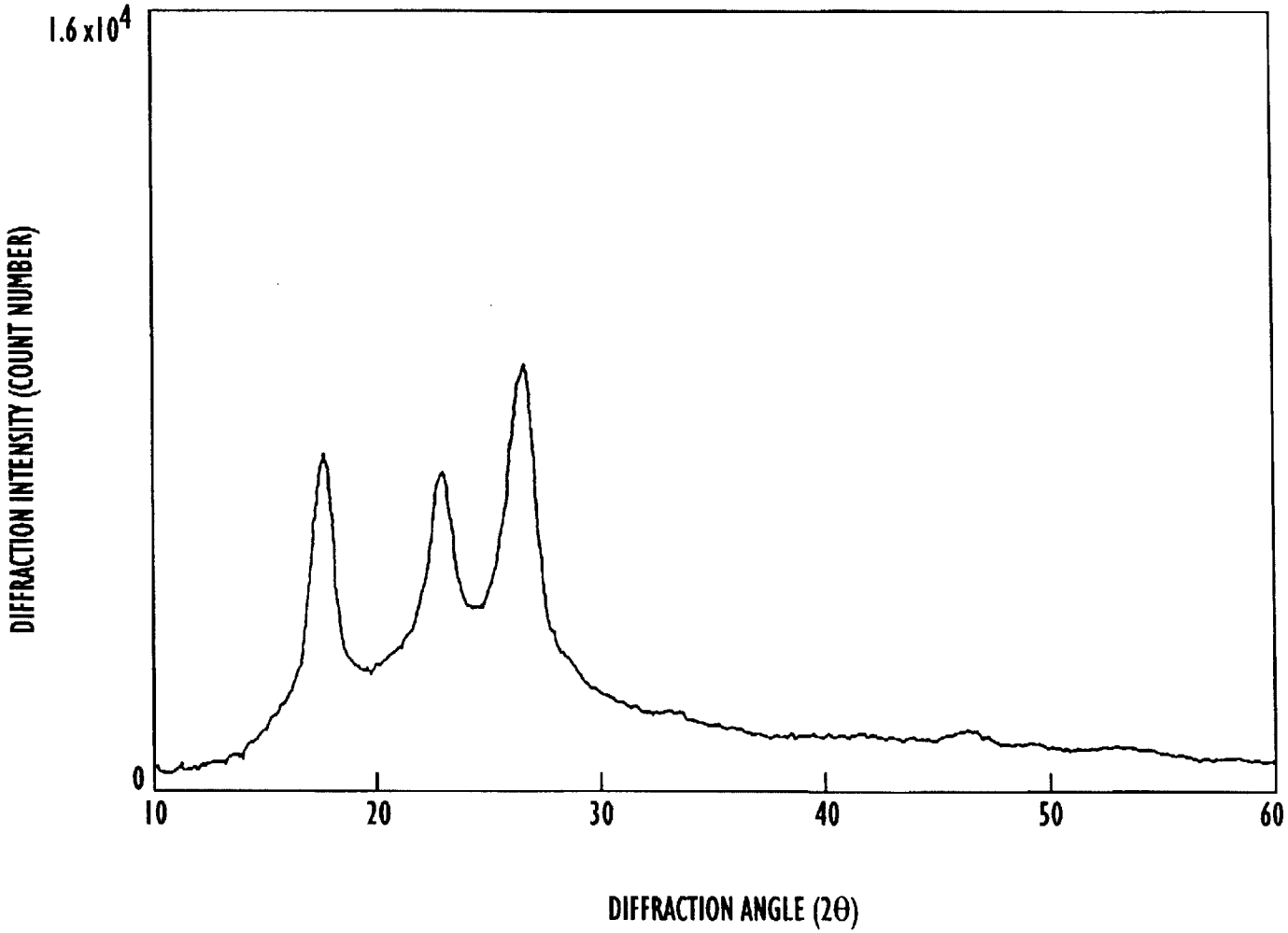
FIG. 5 is a view showing an X-ray diffraction chart of a film layer on the side wall portion of a seamless can of the present invention.
Figure 6:
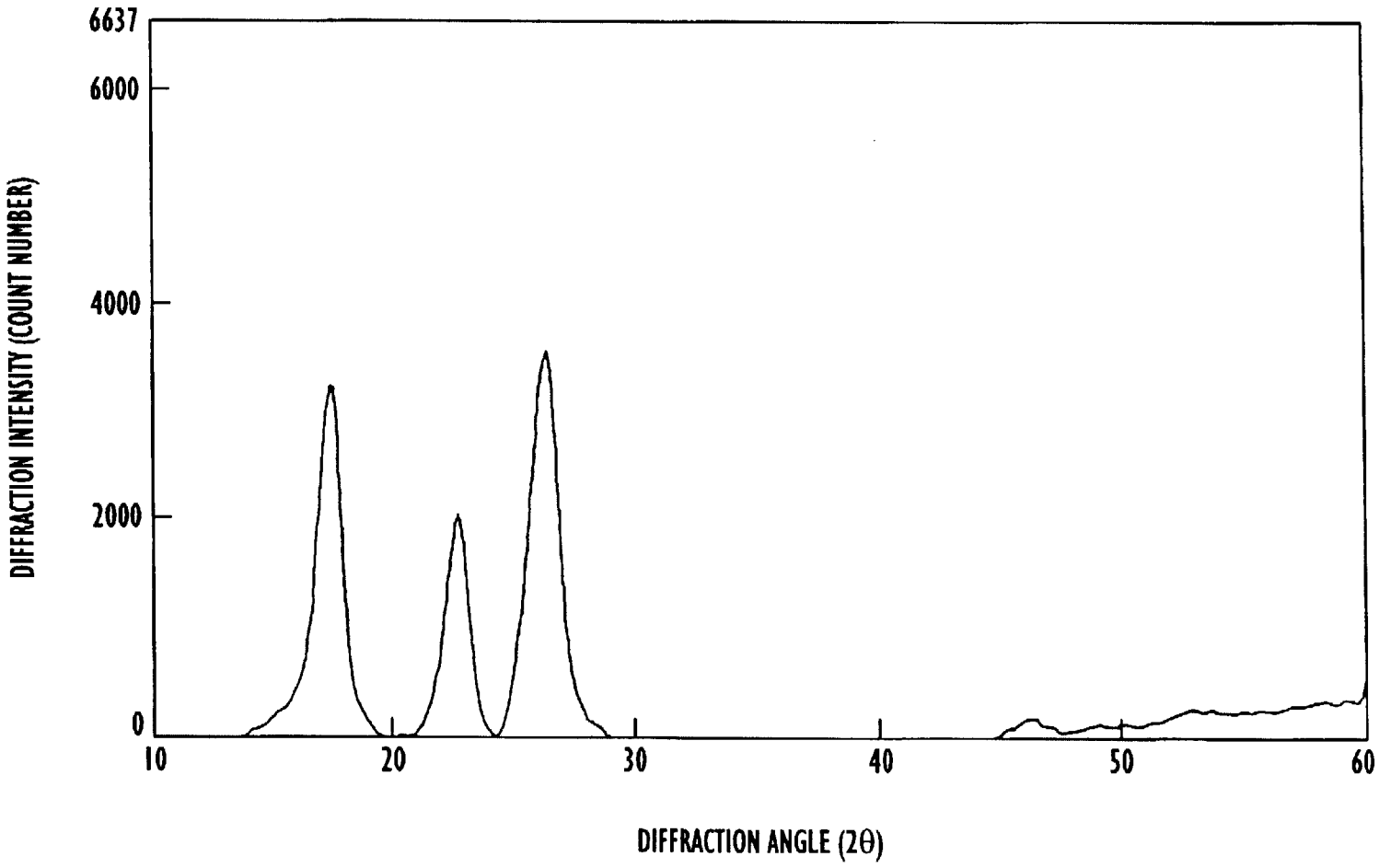
FIG. 6 is a view showing an X-ray diffraction chart after base-line correction of a film layer on the side wall portion of a seamless can of the present invention.

FIG. 5 shows an X-ray diffraction curve obtained when the X-ray diffraction method in FIG. 1 is applied to the polyester film layer on the side wall portion of a seamless can produced by the bend-elongation and ironing method of the present invention. FIG. 6 shows a corrected X-ray diffraction curve obtained by drawing a base line connecting the troughs and feet between peaks in the range of 2θ of from 10° to 60° in the X-ray diffraction curve of FIG. 5.

As seen in these figures, in all cases, a diffraction peak is present when 2θ is in the range of from 14° to 20°, when 2θ is in the range of from 20° to 24° and when 2θ is in the range of from 24° to 29° corresponding to face indices (010), (1–10) and (100), respectively. However, in the seamless can prepared by a conventional bend-elongation method, the peak on the (100) face is relatively large and the peak on the (010) face is relatively small. On the other hand, in the seamless can of the present invention, the peak on the (100) face is reduced and at the same time, the peak on the (010) face is increased relative to a can prepared by a conventional bend-elongation method.

The diffraction peaks in the diffraction patterns shown in FIGS. 3 to 6 obtained by the X-ray diffraction method described in FIG. 1 suggest the following. That is, in this X-ray diffraction method, as shown in the explanatory view of FIG. 7, if the benzene face lies almost parallel to the sample film surface, the reflection on the (010) face nearly perpendicular thereto is measured. Accordingly, a large diffraction peak intensity on the (010) face means that the benzene face of the ethylene terephthalate unit is in parallel with the film surface. On the contrary, a large diffraction peak intensity on the (100) face means that the benzene face of the ethylene terephthalate unit leans away from the film surface and is not parallel to the film surface.

Figure 7:
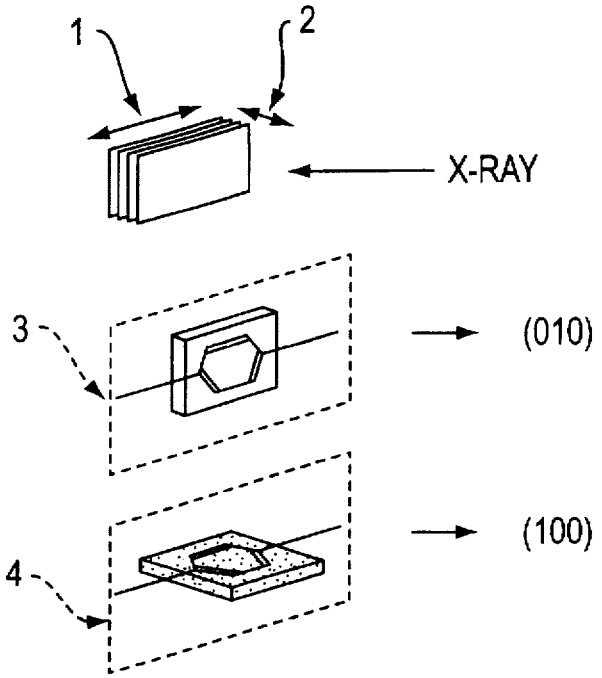
FIG. 7 is a view which shows the relationship between the molecular orientation and diffraction intensity in the X-ray diffraction method.

In reference to FIG. 7, 1 shows the can height direction, 2 shows a plurality of superposed films (six films), 3 shows a parallel orientation of the benzene face of a polyethylene terephthalate where the diffraction peak intensity is stronger on the (010) face, and 4 shows a vertical orientation where the diffraction peak intensity is stronger on the (100) face.

In formula (1), the denominator in the right side indicates the peak intensity on the (100) face and the numerator in the right side indicates the peak intensity on the (010) face. Therefore, the parallel component orientation (D1) defined by formula (1) measures the extent to which the benzene face of the polyethylene terephthalate unit is in parallel with the film surface. As this value becomes larger, the benzene face of the polyethylene terephthalate unit is aligned to a greater degree in parallel with the film surface.

When the side wall portion of the can barrel is bent and elongated in the drawing/redrawing step, the polyethylene terephthalate unit in the film undergoes a molecular orientation in the bend-elongating direction, namely, in the can height direction. That is, the benzene face of polyethylene terephthalate unit tends to lean away from the film surface which results in a large peak intensity on the (100) face as shown in FIGS. 3 and 4.

However, when the side wall portion after bend-elongation is guided to the ironing part of a die (as described below) and subjected to ironing, the polyethylene terephthalate unit in the film is oriented such that the benzene face becomes parallel with the film surface. This results in a large peak intensity on the (010) face as shown in FIGS. 5 and 6. The above-described molecular orientation which places the benzene face in parallel with the film surface results from rolling the polyethylene terephthalate in the seamless can of the present invention.

In the present invention, the benzene face of the polyethylene terephthalate unit in the film is oriented in parallel with the film surface. As described above, this effectively improves shock resistance (dent resistance) and prevents corrosion of metal underneath the film. This phenomenon is related to the fact that fibrillation of the oriented molecules readily occurs when the benzene face of the polyethylene terephthalate unit in the film leans away from the film surface. However, as the benzene face of polyethylene terephthalate unit becomes oriented in parallel with the film surface to a greater extent, fibrillation is reduced.

In the present invention, it is also particularly important that the half width of the peak at a diffraction angle 2θ of from 14° to 20°, namely, on the (010) face, is within 1.8°, preferably within 1.4°.

Figure 8:
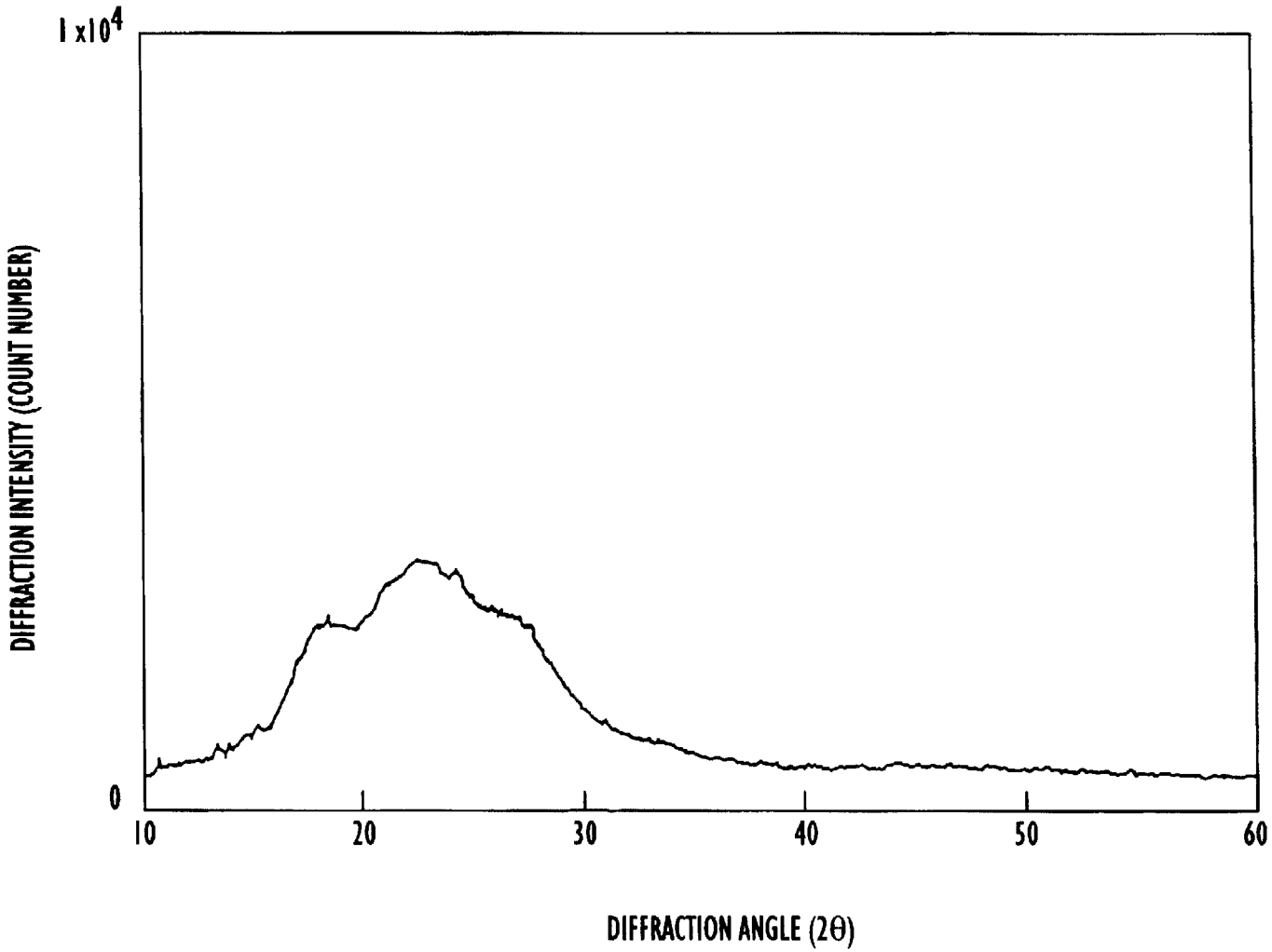
FIG. 8 is a view showing an X-ray diffraction chart of the film layer on the side wall portion of a seamless can comprising an unstretched film laminate.
Figure 9:
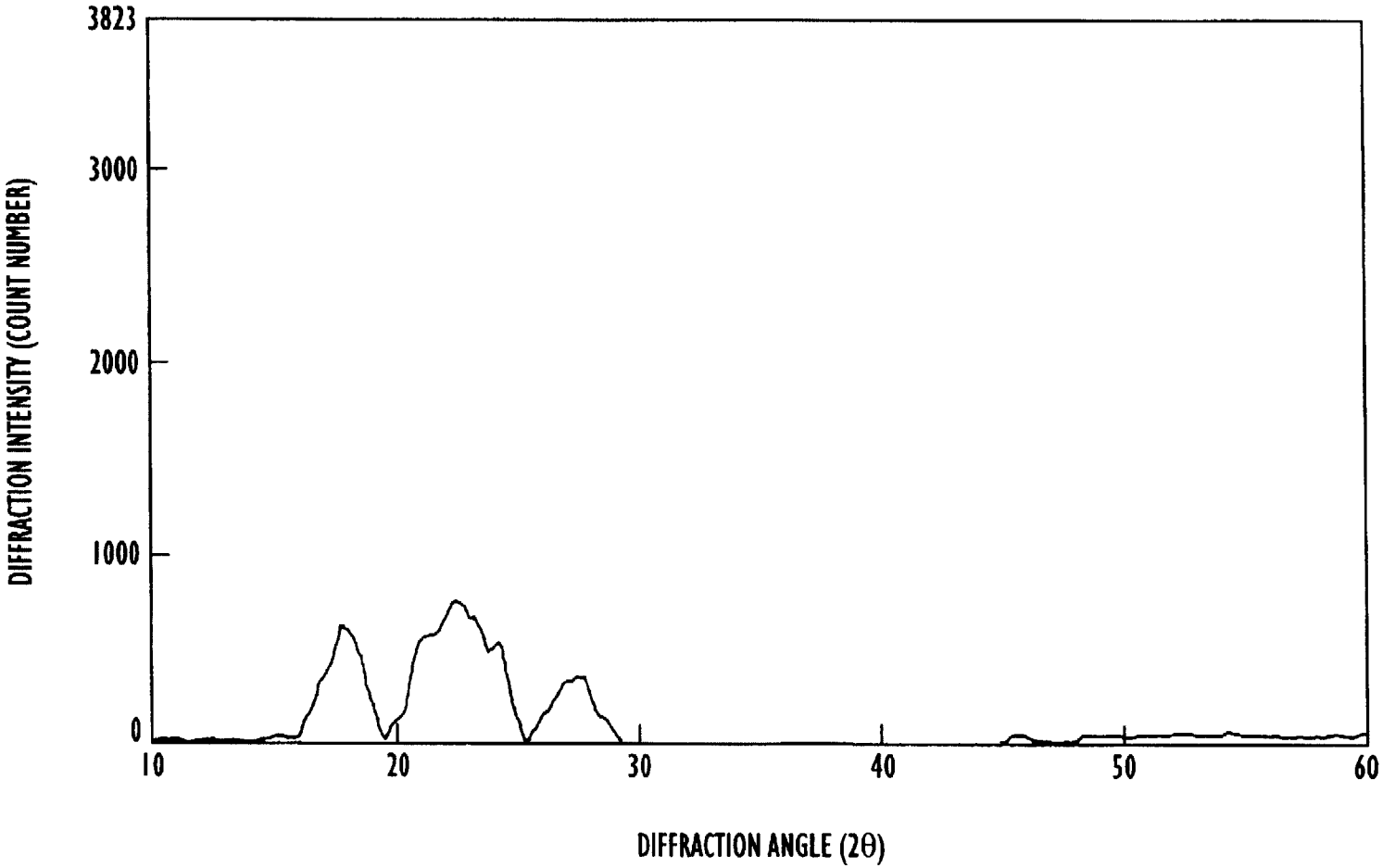
FIG. 9 is a view showing an X-ray chart after baseline correction of a film layer on the side wall portion of a seamless can comprising an unstretched film laminate.

FIG. 8 shows an X-ray diffraction curve obtained when the X-ray diffraction method described in FIG. 1 is applied to the polyester film layer on the side wall portion of a seamless can produced by subjecting a laminate prepared by laminating polyethylene terephthalate in the unstretched state to bend-elongation and ironing. FIG. 9 shows a corrected X-ray diffraction curve obtained by drawing a base line connecting the troughs and feet between peaks in the range of the diffraction angle 2θ of from 10° to 60° in the X-ray diffraction curve of FIG. 8.

Upon comparison of FIGS. 8 and 9 with FIGS. 5 and 6 for the same working but using a laminate prepared by laminating a biaxially stretched polyethylene terephthalate, it is apparent that the half width (Wh) at the face index (010), in the case of using an unstretched film, is more than 1.8°. On the other hand, in the case of using a biaxially stretched film, the half width (Wh) is 1.8° or less.

In the X-ray diffraction of a crystal high polymer it is known that if the following Bragg's formula (4) is satisfied, an intensity peak appears in the resulting interference pattern:

$$n\lambda = 2d_{hkl}\mathrm{Sin}\theta \tag{4}$$

wherein n represents the order, λ represents the wavelength of the X ray, $d_{hkl}$ represents a spacing of (hkl) in the crystal, and θ is the angle of diffraction.

Furthermore, between the steepness of the interference peak and the crystal size, there is a relation defined by the following Scherrer's formula (5):

$$L_{hkl} = \frac{K\lambda}{H\mathrm{Cos}\theta} \tag{5}$$

wherein $L_{hkl}$ represents the dimension of the crystal in a direction perpendicular to the (hkl) face, K represents a constant of about 0.9, H represents a half width (radian) of the interference peak, and λ and θ each has the same meaning as defined in formula (4).

In the present invention, when the half width of the peak at the face index (010) is small, the crystal size in the direction perpendicular to the face, namely, the (100) face direction, is large. This means that not only is the benzene face of the polyethylene terephthalate unit oriented in parallel with the film surface, but also the crystal size in the benzene face direction is large.

In fact, on reviewing the fine crystal size perpendicular to the (010) face based on formula (5), when λ is 1.542 Å (Cu-Kα) and θ (the Bragg angle) is 17.5°, in the present invention, the half width (Wh) is within 1.8° which corresponds to a fine crystal size of 46.3 Å or more. On the other hand, in the polyester film layer of the side wall portion of a seamless can produced by subjecting a laminate prepared by laminating polyethylene terephthalate in the unstretched state to bend-elongation and ironing, the half width (Wh) is 1.9° which corresponds to a fine crystal size of 43.9 Å, namely, a small crystal size.

As described above, in the present invention the benzene face of the polyethylene terephthalate unit is oriented in parallel with the film surface and at the same time, the crystal size in the benzene face direction is relatively large. As a result, the barrier property against corrosive components is remarkably improved. Also, in a denting test, cracks in the film perpendicular to the metal substrate (cracks in the film along the thickness direction) are reduced, and excellent corrosion resistance and excellent shock resistance can be achieved in combination. This is shown in the comparison of Example 1 with Example 10 which is described below.

According to a preferred embodiment of the seamless can of the present invention, in the polyester film layer on the side wall portion of the can barrel, the birefringence ($\Delta n$) defined by formula (2) is from 0.020 to 0.180 on the front surface side ($\Delta n_1$) of the polyester film and from 0.005 to 0.120 on the side in contact with the metal sheet ($\Delta n_4$). At least two or more birefringence peaks are present along the thickness direction from the front surface to the metal sheet side, a birefringence peak ($P_1$)($\Delta n_2$) is present in the vicinity of the front surface side and a birefringence peak ($P_2$)($\Delta n_3$) is present in the vicinity of the metal sheet side.

This orientation distribution in the film thickness direction occurs because the molecular orientation is reduced on the metal sheet side due to partial or complete fusion upon heat bonding of polyester and abrupt cooling subsequent thereto. Whereas, on the front surface of the polyester film, because the temperature at the time of heat bonding is relatively low and the reduction in temperature by quenching is fast, the biaxial orientation of the polyester film remains although it may be relaxed to a certain degree.

In the seamless can of the present invention, an orientation peak higher than the orientation peak on the front surface side is present along the thickness direction from the front surface to the surface on the metal sheet side. In other words, the highest degree of biaxial molecular orientation is present along the film thickness direction.

Figure 10:
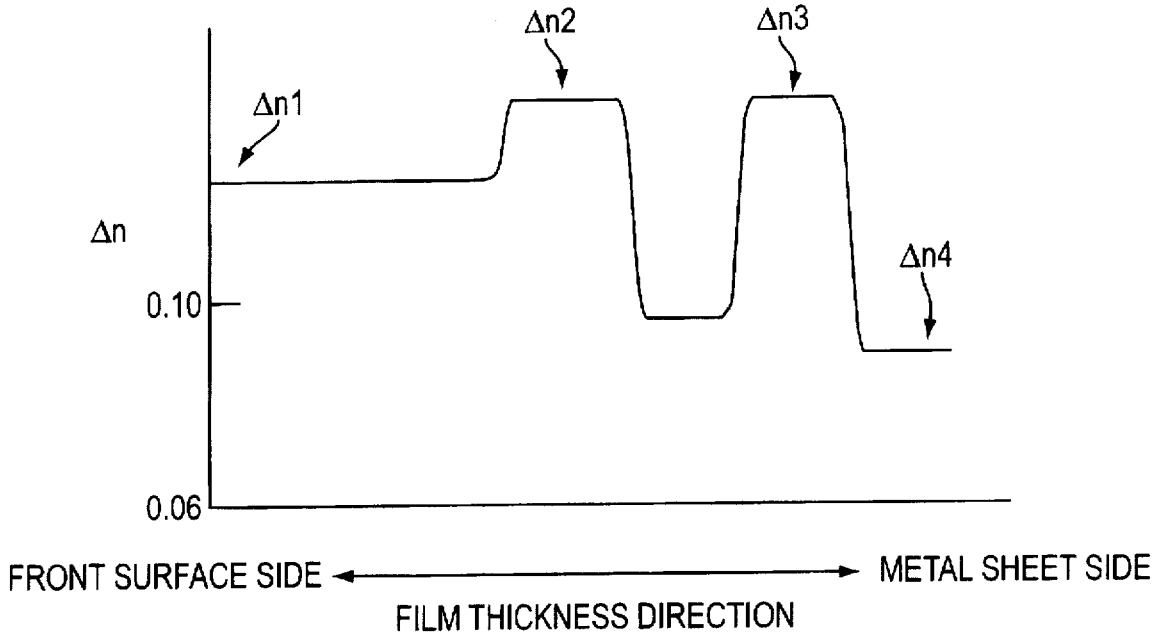
FIG. 10 is a view showing the birefringence distribution of a film layer on the side wall portion of a can.
Figure 11:
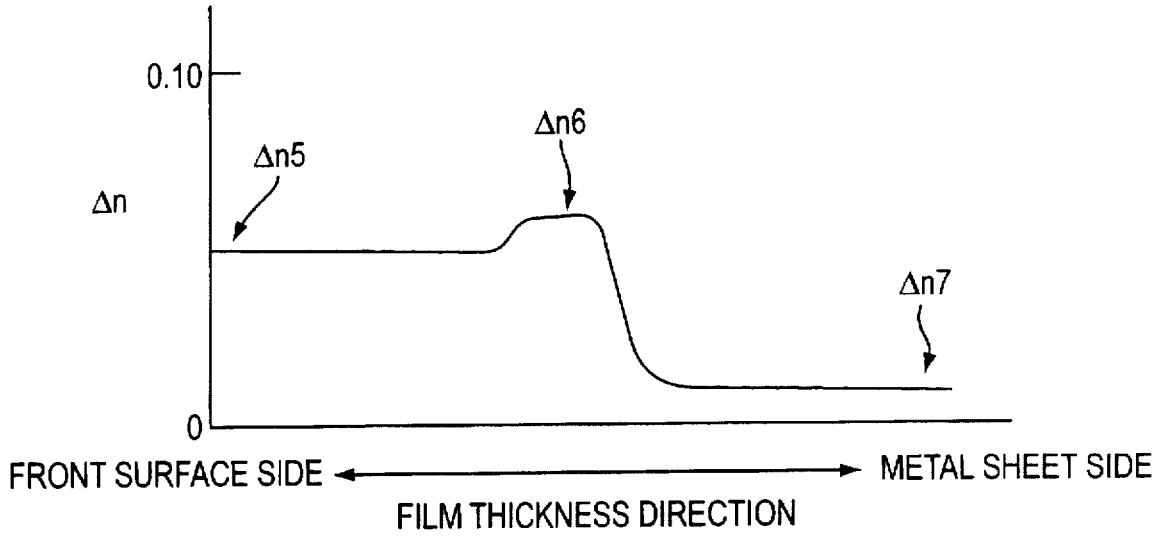
FIG. 11 is a view showing a birefringence distribution of the film layer on the bottom portion of a can.

FIG. 10 is a graph plotting the relationship, in the laminate on the side wall portion of the seamless can of the present invention, between the dimension in the thickness direction starting from the front surface of the film and the orientation by birefringence ($\Delta n$) of the polyester. FIG. 10 shows an orientation peak higher than the orientation on the front surface side is present along the thickness direction from the front surface to the surface on the metal sheet side.

Due to the above-described orientation distribution in the thickness direction, the seamless can of the present invention has an excellent workability and sealing property simultaneous with excellent flavor retentivity and corrosion resistance.

Table 2 shows the orientation distribution in the thickness direction for the Examples below. The film front surface side desirably has a high orientation as compared with the metal sheet side. However, consider a seamless can having no orientation peak higher than the orientation peak on the front surface side along the thickness direction. If the orientation on the front surface side is low (Example 11), even though satisfactory workability and film adhesion may be obtained, a reduction in flavor retentivity tends to occur due to adsorption of flavor of the contents or underfilm corrosion (UFC). On the other hand, in the above-described polyester-metal laminated sheet, when the orientation on the front surface side is increased to maintain the biaxial molecular orientation (Example 12), the workability is poor and in severe working such as deep-drawing, the film may be broken or peeled off or cracks or pinholes may be generated.

On the contrary, in the case of a polyester-metal laminated sheet according to a preferred embodiment of the present invention where the film front surface side has an orientation higher than that on the metal sheet side and an orientation peak higher than the orientation peak on the front surface is present along the thickness direction from the front surface to the surface of the metal sheet side (Example 1), the adhesion of the film to the metal is good. Also, severe working such as deep-drawing can be applied without breaking or peeling the film or generating cracks or pinholes, the laminate film after the working has excellent flavor retentivity free of adsorption of flavor components of the contents, the corrosion resistance is excellent, and no underfilm corrosion (UFC) is observed. In addition, not only the above-described properties are maintained in the flange portion of a deep-drawn can and in the vicinity thereof, but these portions also have excellent dent resistance.

The polyester layer of the seamless can of the present invention comprises a low orientation part on the metal sheet side, a relatively high orientation part on the front surface side and a peak part having the highest orientation along the thickness direction between the front sheet side and the metal sheet side. Of these parts, the low orientation part on the metal sheet side participates in adhesion to the metal sheet, and the relatively high orientation part on the surface side is of auxiliary use in preventing the adsorption of flavor components. The peak part having the highest orientation along the thickness direction serves as a barrier against corrosive components, prevents the adsorption of flavor components, and contributes to an improvement in dent resistance.

According to a preferred embodiment of the seamless can of the present invention, in the polyester film layer on the can bottom portion, the birefringence ($\Delta n$) determined by a birefringence method and defined by the following formula (3) is from 0.020 to 0.140 on the front surface side ($\Delta n_5$) and from 0.005 to 0.100 on the side in contact with the metal sheet ($\Delta n_7$), at least one birefringence peak ($\Delta n_6$) is present along the thickness direction from the front surface side to the metal sheet side, and the birefringence ($\Delta n_6$) peak is from 0.020 to 0.160 and at least 0.005 higher than the birefringence of the higher side of the foot of the peak:

$$\Delta n_{5-7}=n_m-n_t \quad (3)$$

wherein $n_m$ is a refractive index in the direction of a maximum orientation of the film and $n_t$ is a refractive index in the thickness direction of the film.

The birefringence ($\Delta n$) on the front surface side of the polyester film is from 0.020 to 0.140. If it is less than this range, the dent resistance on the bottom portion is lowered, whereas if it exceeds this range, the film cannot endure formation of the can barrel, cracks are formed in the can barrel film and corrosion resistance is reduced.

If the birefringence on the side in contact with the metal sheet is lower or higher than the above-described range, adhesion to the metal is reduced. This is because it is considered that heat treatment may cause heat crystallization at the time of packing, or may cause a pseudo crystallization phenomenon during storage after packing to thereby generate distortion stress.

The birefringence ($\Delta n_6$) along the thickness direction is preferably from 0.02 to 0.160 in view of corrosion resistance, adsorption prevention of flavor components and dent resistance.

In the seamless can of the present invention, the polyester layer at the flange portion is subjected to severe double seam working and therefore, it preferably has a parallel component orientation (D1) in a relatively low range as compared with the polyester layer on the can side wall portion. The parallel component orientation (D1) is generally 10% or more and the half width of the peak at a diffraction angle 2θ of approximately from 14° to 20° preferably falls within 1.8°.

If D1 is less than 10%, when the packing is conducted at a low temperature lower than the Tg of the film, cracks are often generated in the film on the double seamed portion and the corrosion resistance and sealing property are reduced. The same occurs when the half width exceeds 1.8°.

PREFERRED EMBODIMENTS OF THE INVENTION

Figure 12:
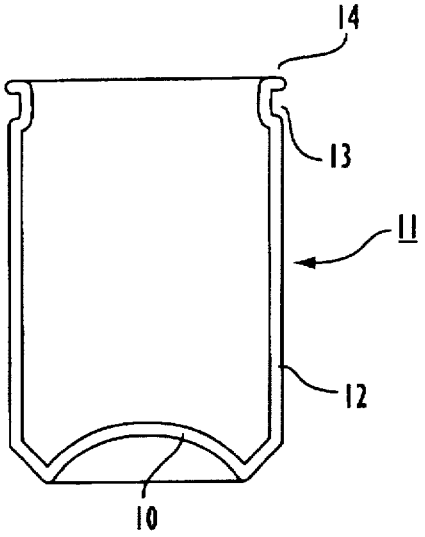
FIG. 12 is a view showing an example of a seamless can.

FIG. 12 shows an example of the seamless can of the present invention. The deep-drawn can 11 is formed by bend-elongating and ironing the above-described polyester-metal laminate. The seamless can comprises a bottom portion 10 and a side wall portion 12. At the upper end of the side wall portion 12, a flange portion 14 is formed through a neck portion 13, if desired. In the can 11, the thickness of the side wall portion 12 is reduced as compared to that of the bottom portion 10, by bend-elongation and specific ironing to from 30 to 85% of the original thickness of the laminate.

Figure 13:
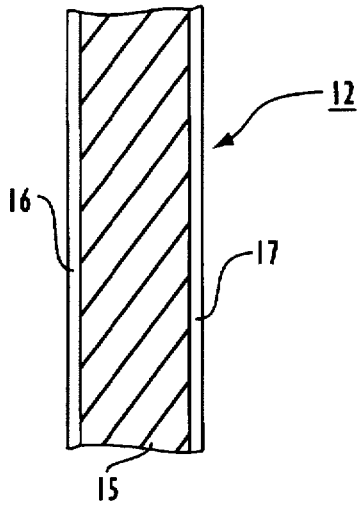
FIG. 13 is a view showing the cross-sectional structure of the side wall portion of a seamless can.

FIG. 13 shows an example of the cross-sectional structure of the side wall portion 12. The side wall portion 12 comprises a metal base 15 and a polyester film 16. An outer surface film 17 is provided on the metal substrate 15. The outer surface film 17 may be the same as the inner surface film 16, or may be a paint or a resin film coating usually used for cans.

Figure 14:
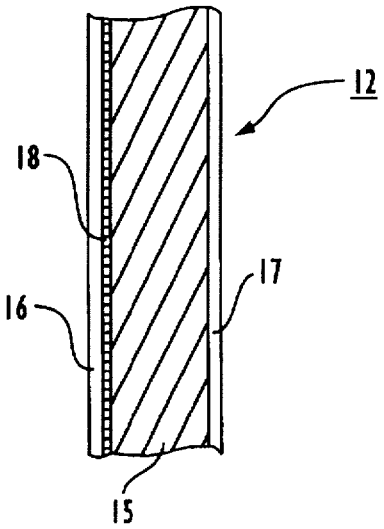
FIG. 14 is a view showing the cross-sectional structure of the side wall portion of a seamless can having an interposed primer layer.

FIG. 14 shows another example of the cross-sectional structure of the side wall portion. FIG. 14 differs from FIG. 13 in that a primer layer 18 for adhesion is provided between the polyester layer 16 and the metal substrate 15.

The cross-sectional structure of the bottom portion 10 generally is the same as the cross-sectional structure of the side wall portion 12, except that no working for reducing the thickness is applied.

Metal Sheet:

In the present invention, various surface-treated steel plates and light metal sheets such as an aluminum plate may be used as the metal sheet.

The surface-treated steel plate includes those obtained by annealing a cold-rolled steel plate, subjecting it to secondary cold rolling and applying thereon one or more surface treatments such as zinc plating, tin plating, nickel plating, treatment with an electrolytic chromic acid and treatment with a chromic acid. A preferred example of the surface-treated steel plate is a steel plate treated with electrolytic chromic acid. The treated surface comprises from 10 to 200 $mg/m^2$ of a metal chromium layer and from 1 to 50 $mg/m^2$ (in terms of metal chromium) of a chromium oxide layer. This treatment in particular provides excellent coating adhesion and corrosion resistance in combination. Another example of the surface-treated steel plate is a hard tin plate having a tin plating amount of from 0.5 to 11.2 $g/m^2$. This tin plate is preferably subjected to treatment with chromic acid or chromic acid-phosphoric acid to provide a chromium amount in terms of metal chromium of from 1 to 30 $mg/m^2$.

Still another example is an aluminum-coated steel plate subjected to aluminum plating or aluminum press-adhesion.

The light metal plate includes an aluminum plate and an aluminum alloy plate. The aluminum alloy plate has excellent corrosion resistance. With regard to workability, the aluminum alloy plate has a composition such that Mn is from 0.2 to 1.5 wt %, Mg is from 0.8 to 5 wt %, Zn is from 0.25 to 0.3 wt % and Cu is from 0.15 to 0.25 wt % with the balance being Al. The light metal plate is also preferably subjected to treatment with chromic acid or chromic acid/phosphoric acid to provide a chromium amount in terms of metal chromium of from 20 to 300 $mg/m^2$.

The blank thickness of the metal plate, namely, the thickness ($t_B$) of the can bottom portion, varies depending upon the kind of metal or the use or size of the container. However, the thickness ($t_B$) in general is preferably from 0.10 to 0.50 mm and more preferably, in the case of a surface-treated steel plate, from 0.10 to 0.30 mm and in the case of a light metal plate, from 0.15 to 0.40 mm.

Polyester Film:

The polyester film for use in the present invention is preferably a homopolyester or copolyester derived from a dibasic acid mainly comprising terephthalic acid and a diol mainly comprising ethylene glycol.

Examples of the dibasic acid include, in addition to terephthalic acid, isophthalic acid, P-β-oxyethoxybenzoic acid, naphthalene-2,6-dicarboxylic acid, diphenoxyethane-4,4-dicarboxylic acid, 5-sodium sulfoisophthalic acid, hexahydroterephthalic acid, adipic acid and sebacic acid.

Examples of the diol component include, in addition to ethylene glycol, glycol components such as propylene glycol, 1,4-butanediol, neopentyl glycol, 1,6-hexylene glycol, diethylene glycol, triethylene glycol, cyclohexanedimethanol and an ethylene oxide adduct of bisphenol A.

The acid component of the copolyester preferably comprises a terephthalic acid and an isophthalic acid to provide better control of orientation and the degree of crystallization, particularly in view of flavor retentivity. The acid component may contain other dibasic acid components in a small amount, for example, in an amount of 3 mol % or less. However, in order to prevent the adsorption of flavor components and to suppress the elution of polyester components, at least the container inner surface polyester layer preferably does not contain an aliphatic dibasic acid. The polyester containing an isophthalic acid as the acid component provides a large barrier effect against various components, flavor components or corrosive components and also reduces adsorption of these components.

As the diol component of the copolyester, those mainly comprising ethylene glycol are preferred. In view of molecular orientation or a barrier property against corrosive components and flavor components, the diol component preferably comprises ethylene glycol in a proportion of 95 mol % or more, more preferably 97 mol % or more.

The homopolyester or copolyester has a molecular weight in the range of film formation, and preferably has an intrinsic viscosity (η) measured using a phenol/tetrachloroethane mixed solvent of from 0.5 to 1.5, preferably from 0.6 to 1.5.

The polyester layer in the metal sheet-polyester laminate for use in the present invention may be a film comprising a single homopolyester or copolyester, a blend film comprising two or more of these polyesters, or a laminate film comprising a laminate of two or more polyester films.

The acid component of the copolyester preferably comprises, on average, from 80 to 100% of a terephthalic acid and from 0 to 20% of an isophthalic acid. The term "on average" as used herein means that the polyester film may be a blend of plural kinds of copolyesters differing in isophthalic acid content, or may be a laminate film comprising plural kinds of copolyesters differing in isophthalic acid content. In the latter case, a copolyester having a larger isophthalic acid content is disposed on the side in contact with the metal sheet.

The thickness of the polyester film for use in the present invention as a whole is preferably from 2 to 100 μm, and more preferably from 5 to 50 μm in view of its protection effect of the metal and workability.

Generally, the polyester film is biaxially stretched. The degree of biaxial orientation may be confirmed by an X-ray diffraction method, a polarized fluorometric method, a birefringence method or a density gradient piping method. The degree of biaxial stretching of the film has a great influence on the half width (Wh) on the (010) face, and accordingly, on the size of fine crystals in parallel with the film surface.

Known compounding agents, for example, an antiblocking agent such as amorphous silica, a pigment such as titanium oxide (titanium white), various antistatic agents and a lubricating agent may be added to the polyester film according to a known formulation.

Although not generally needed, in case of using a primer for adhesion, and in order to increase adhesion of the primer for adhesion to the film, the surface of the biaxially stretched polyester film in general is preferably subjected to a corona discharge treatment. The corona discharge treatment is preferably carried out to the extent that the wet tension is 44 dynes/cm or more.

In addition, the film may be subjected to known surface treatments for improving adhesion such as plasma treatment or flame treatment or to a coating treatment for improving adhesion with a urethane resin or a modified polyester resin.

Method of Producing Laminate:

The polyester-metal laminated sheet for use in the present invention may be produced by heat bonding a biaxially stretched polyester film to a metal. The seamless can obtained from the film preferably has the above-described orientation distribution which can be obtained using the phenomenon of orientation return in the transition state of the polyester from the molten phase to the solid phase.

Figure 15:
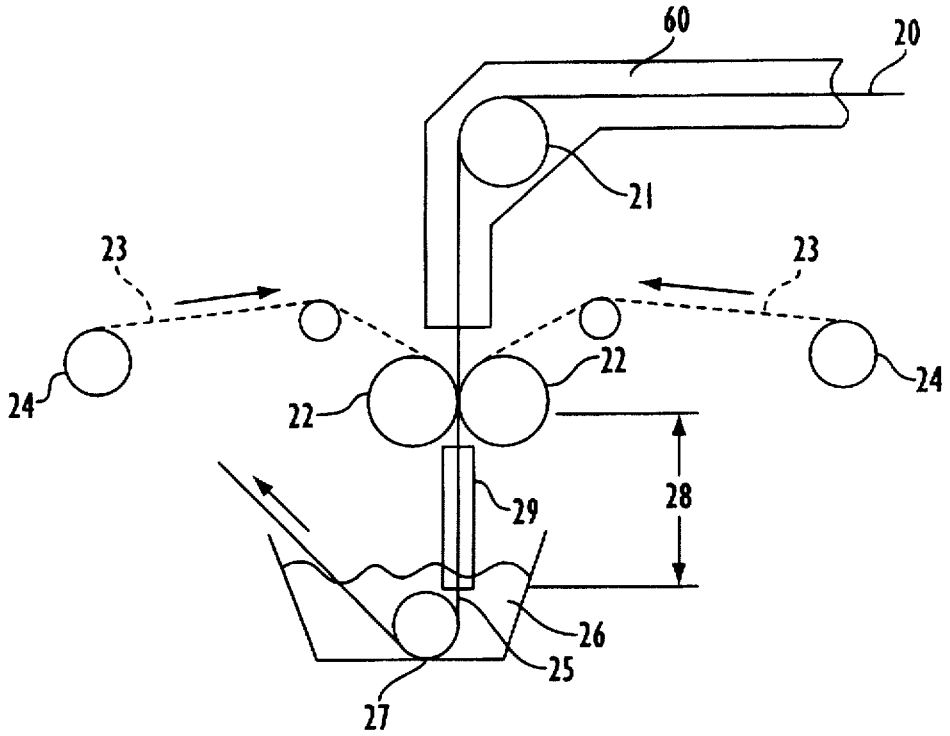
FIG. 15 is a schematic view of a production apparatus for making a laminated metal sheet.

In FIG. 15 which explains a method for producing the polyester-metal laminated sheet, a metal sheet 20 is heated by a heating roller 21 in heating zone 60 at a temperature ($T_1$) higher than the melting point (Tm) of the polyester 23, and then fed between laminate rollers 22 and 22. On the other hand, polyester films 23 are unwound from feeding rollers 24 and fed in a positional relation such that the metal sheet 20 is sandwiched by the laminate rollers 22 and 22. The laminating rollers 22 and 22 are kept at a temperature ($T_2$) slightly lower than that of the heating roller 21 to heat-bond the polyester films onto both surfaces of the metal sheet 20. At the lower side of laminate rollers 22 and 22, a water tank is provided containing cooling water 26 for quenching the laminate 25 thus formed. A guide roller 27 for guiding the laminate is disposed in the water tank. Between the laminate rollers 22 and 22 and the cooling water 26, a gap 28 in a predetermined distance is formed, and a heat-reserving mechanism 29 is provided in the gap 28 to maintain a constant temperature range ($T_3$). In this manner, during the transition state of the polyester from a molten phase to a solid phase, peaks in the biaxial orientation along the film thickness direction can be formed due to orientation return.

The heating temperature ($T_1$) of the metal sheet is generally from (Tm−50° C.) to (Tm+100° C.), more preferably from (Tm−50° C.) to (Tm+50° C). The temperature ($T_2$) of the laminate rollers 22 is suitably from ($T_1$−300° C.) to ($T_1$−10° C.), preferably from ($T_1$−250° C.) to ($T_1$−50° C.). By setting the temperature to fall in the above-described range, a temperature gradient corresponding to the temperature difference is formed in the polyester on the metal sheet, and the temperature gradient gradually shifts toward the low temperature side and at last vanishes. However, the portion along the thickness direction of the polyester from the front surface side to the metal sheet side passes over a sufficiently long time through the temperature region where the orientation return phenomenon takes place in the transition state from a molten phase to a solid phase. Accordingly, it is effective to maintain the temperature of the laminate after the passing through laminate rollers in the heat-reserving zone. The temperature ($T_3$) is based on the temperature $T_2$ of laminate rollers 22. That is, ($T_3$) is from (Tg+5° C.) to (Tm−5° C.), and preferably from the heat set temperature of the biaxially stretched film to (Tm−5° C.). The duration of maintaining the temperature $T_2$ is suitably from 0.1 to 10 seconds, preferably from 0.1 to 3 seconds.

The adhesive primer provided, if desired, between the polyester film and the metal blank provides excellent adhesion both to the metal blank and to the film. Representative examples of the primer coating having excellent adhesion and corrosion resistance include a phenol-epoxy based coating comprising a resol-type phenolaldehyde resin derived from various phenols and formaldehyde and a bisphenol-type epoxy resin. A coating containing a phenol resin and an epoxy resin at a weight ratio of from 50:50 to 5:95, preferably from 40:60 to 10:90, is particularly preferred.

The adhesive primer layer in general preferably has a thickness of from 0.01 to 10 μm. The adhesive primer layer may be applied to the metal blank or may be applied to the polyester film prior to forming the laminate.

Production of Seamless Can:

The seamless can of the present invention is produced by drawing/deep-drawing the above-described polyester-metal laminate between a punch and a die to form it into a cup having a bottom, and bend-elongating and ironing at the deep-drawing stage to reduce the thickness of the side wall portion of the cup.

Figure 16:
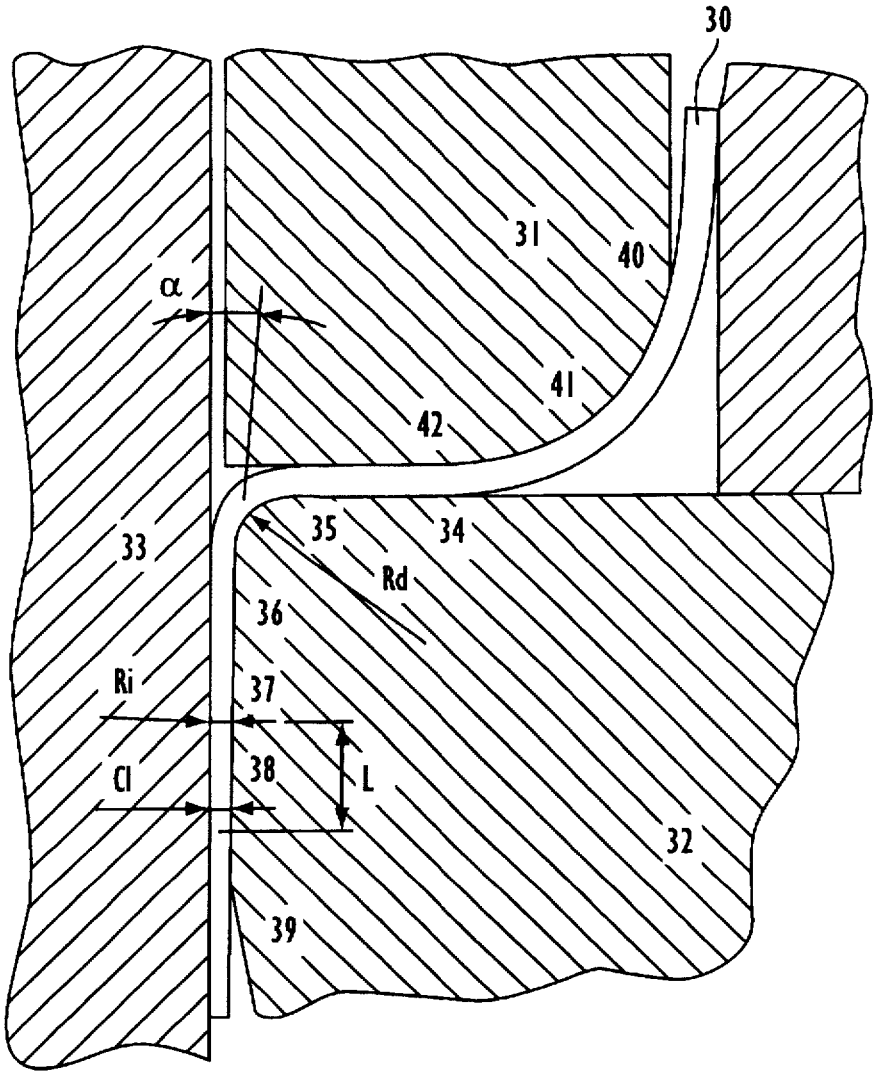
FIG. 16 is an explanatory view of the drawing-ironing formation of a laminated sheet.

The drawing-ironing formation of the laminate sheet is conducted by the following means. That is, as shown in FIG. 16, the pre-drawn cup 30 formed from a coated metal sheet is held by an annular holding member 31 inserted in the cup and a redrawing-ironing die 32 disposed beneath the member. Concentric with the holding member 31 and the redrawing-ironing die 32, a redrawing-ironing punch 33 is provided removably in or out of the holding member 31. The redrawing-ironing punch 33 and the redrawing-ironing die 32 are moved relative to each other so as to be in mesh with one another.

The redrawing-ironing die 32 has a plane part 34 at the upper portion, a working corner part 35 having a small radius of curvature at the periphery of the plane part, a tapered approach part 36 having a diameter which increases downwardly on the periphery connected to the working corner part, and a cylindrical land part for ironing (ironing part) 38 connected to the approach part through a small curvature part 37. A reverse-tapered recess 39 is provided at the lower part of the land part 38.

The side wall portion of the pre-drawn cup 30 is vertically bent inward of the diameter upon passing through the outer peripheral surface 40 of the annular holding member 31 and the curvature corner part 41 thereof, bent nearly vertically in the axial direction at the working corner part 35 of the redrawing-ironing die 32 upon passing through the part defined by an annular bottom surface 42 of the annular holding member 31 and the plane part 34 of the redrawing-ironing die 32, and formed into a deep-drawn cup having a size smaller than that of the pre-drawn cup 30. In this case, at the working corner part 35, the portion opposite the side in contact with the corner part 35 is elongated by bending deformation. On the other hand, the portion in contact with the working corner part is elongated by return deformation after leaving the working corner part, to thereby achieve a reduction in the thickness of the side wall portion by bend-elongating.

The outer surface of the side wall portion reduced in thickness by the bend-elongation comes into contact with the approach part 36 having a small taper angle and having a diameter which gradually increases. While leaving the inner surface in the free state, the approach part 36 is guided into the ironing part 38. The travel of the side wall portion passing through the approach part is a prestage of the ironing subsequent thereto, where the bent-elongated laminate is stabilized and the size of the side wall portion is slightly contracted to prepare for ironing. More specifically, immediately after bend-elongation the laminate is in an unstable state. That is, the laminate is sensitive to vibration due to the bend-elongation and also the inside of the film is distorted. Accordingly, smooth ironing cannot be achieved if the laminate is immediately subjected to ironing. However, according to the present invention, the outer surface side of the side wall portion is placed into contact with the approach part 36 to contract the diameter and lay the inner surface side in the free state. This terminates the influence of vibration and relaxes heterogenous distortion within the film. As a result, smooth ironing can be achieved.

The side wall portion after passing through the approach part 36 is introduced into the clearance between the land part for ironing (ironing part) 38 and the redrawing-ironing punch 33 and rolled to the thickness defined by the clearance (C1). In the present invention, the final thickness C1 of the side wall portion is set to be from 30 to 85% of the original thickness (t) of the laminate. The small curvature part 37 at the introduction side of the ironing part effectively fixes the starting point of ironing to thereby smoothly introduce the laminate into the ironing part 38. The reverse-tapered recess 39 at the lower part of the land part 38 prevents an excessive increase in the working force.

The radius of curvature of the curvature corner part 35 in the redrawing-ironing die 32 preferably is 2.9 times or less the thickness (t) of the laminate to provide effective bend-elongation. However, the laminate may be broken if the radius of curvature is too small. Thus, the radius of curvature preferably is 1 times or more the thickness (t) of the laminate.

The approach angle $\alpha$ (half of the taper angle) of the tapered approach part 36 is preferably from 1° to 5°. If the angle of the approach part is less than the above-described range, the relaxation of orientation in the polyester film layer or stabilization before ironing is insufficient, whereas if the angle of the approach part exceeds the above-described range, the bend-elongation is non-uniform (return deformation is insufficient). As a result, it becomes difficult to effect ironing to provide the desired orientation of the polyester film as described above without causing cracks or peeling of the film.

The radius of curvature Ri of the small curvature part 37 is preferably from 0.3 to 20 times the thickness (t) of the laminate to effectively fix the ironing starting point. However, if the radius of curvature is excessively large, the laminate may be shaved. Accordingly Ri is preferably 20 times or less the thickness of the laminate.

The clearance between the land part 38 for ironing and the redrawing-ironing punch 33 is in the range as described above, and the land length L in general is preferably from 0.5 to 3 mm. If the length exceeds the above-described range, the working force tends to excessively increase, whereas if L is less than the above-described range, the return after ironing work is large and sometimes causes disadvantageous results.

In the present invention, the polyester layer at the flange portion is subjected to severe double seam working. Accordingly, the polyester layer at the flange portion preferably has a parallel component orientation (D1) in a relatively low range as compared with that of the polyester layer on the can side wall portion, and the parallel component orientation (D1) in general is preferably 10% or more. Furthermore, the half width (Wh) of the peak at a diffraction angle 2θ of from 14° to 20° falls within 1.8°. By adjusting the characteristics of the polyester layer at the flange portion as described above, the sealing property and corrosion resistance at the double seamed portion can be improved.

To this effect, a flange forming portion having a thickness larger than the thickness of the side wall portion of the can is formed at the upper end of the can side wall portion after ironing. When the thickness of the side wall portion of the can is t1 and the thickness of the flange portion is t2, the ratio t2/t1 is preferably from 1.0 to 2.0, more preferably from 1.0 to 1.7.

Figure 17:
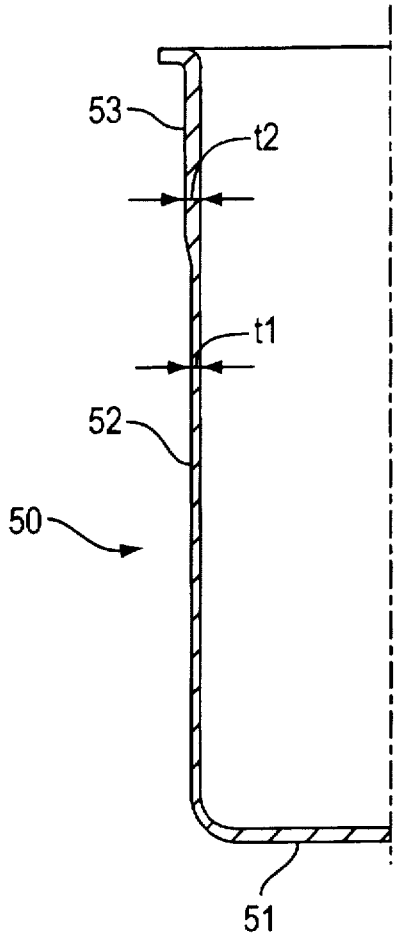
FIG. 17 is a cross section of a seamless can having a specific flange portion.
Figure 18:
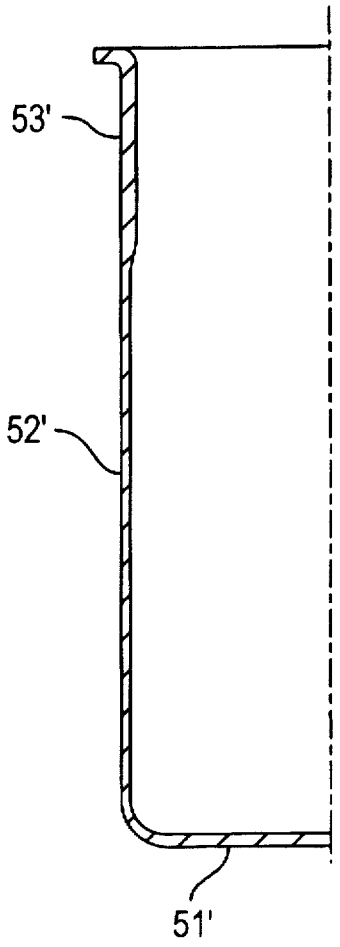
FIG. 18 is a cross section of a seamless can having a specific flange portion.
Figure 19:
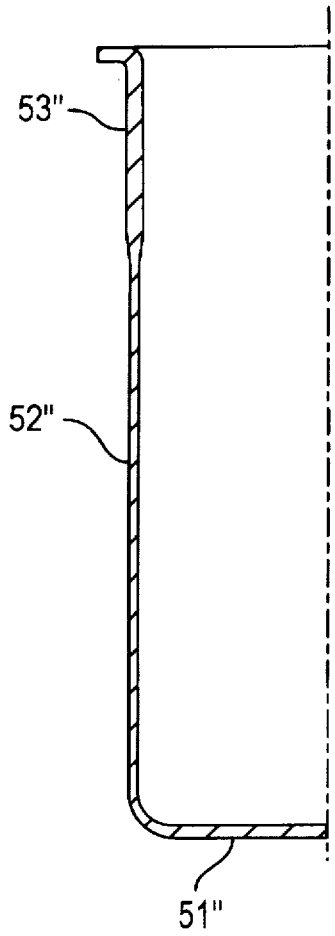
FIG. 19 is a cross section of a seamless can having a specific flange portion.

FIGS. 17, 18 and 19 each show a seamless can after the drawing/redrawing formation. The seamless can 50 comprises a bottom portion 51 having almost the same thickness as the thickness of the metal blank and a side wall portion 52 having a thickness reduced by the redrawing-ironing. At the upper portion of the side wall portion 52, a flange forming portion 53 having a thickness that is larger than that of the side wall portion is formed.

Of course, the flange forming portion and the side wall portion may have the same thickness (not shown).

The flange forming portion 53 may comprise various structures. In the example shown in FIG. 17, the inner surface of the side wall portion 52 and the inner surface of the flange forming portion 53 lie on a cylindrical surface having the same diameter, and the outer surface of the flange forming portion 53 has a diameter larger than that of the outer surface of the side wall portion 52. This type of flange forming portion 53 is formed by setting the land part of the redrawing-ironing die to a short length L and, at the same time, providing a part having a diameter smaller than that of the land part following the land part so that the flange forming portion 53 can be subjected to return deformation.

In the flange forming portion 53' shown in FIG. 18, the outer surface of the side wall portion 52' and the outer surface of the flange forming portion 53' lie on a cylindrical surface having the same diameter, and the inner surface of the flange forming portion 53' has a diameter smaller than that of the inner surface of the side wall portion 52'. This type of flange forming portion 53' is formed by setting the part of redrawing-ironing punch 33 where the flange forming portion 53' reaches as a result of elongating the side wall portion to a diameter that is smaller than the diameter of other portions of the redrawing-ironing punch 33.

In the flange forming portion 53" shown in FIG. 19, the outer surface of the flange forming portion 53" has a diameter larger than that of the outer surface of the side wall portion 52". Also, the inner surface of the flange forming portion 53" has a diameter smaller than that of the inner surface of the side wall portion 52". This type of flange forming portion 53" is formed by setting the part of the redrawing-ironing punch 33 where the flange forming portion 53" reaches as a result of elongating the side wall portion to a diameter that is smaller than the diameter of other portions of the redrawing-ironing punch 33, setting the land part of the redrawing-ironing die to a short length L, and providing a part having a diameter smaller than that of the land part at the part following the land part so that the flange forming part 53" can be subjected to return deformation.

In producing a seamless can of the present invention, the polyester layer on the surface imparts sufficiently high lubrication performance. However, in order to further increase lubricity, a lubricating agent selected from various fats and oils or waxes may be coated in a small amount. An aqueous coolant (including that used for cooling the work) may be used, but this is not preferred in view of maintaining a simple operation.

The temperature at the time of redrawing-ironing working (the temperature immediately after completion of the ironing) is preferably from 10° C. to a temperature 50° C. higher than the glass transition temperature (Tg) of the polyester. Accordingly, the tools are preferably heated or cooled as needed.

According to the present invention, the container after the drawing formation can subsequently be subjected to heat treatment in one or more stages. The heat treatment is conducted for various purposes and mainly for removing the distortion remaining in the film generated due to working, for evaporating the lubricating agent used at the time of working from the surface, and for dry-hardening the printing ink printed on the surface. The heat treatment may use a known heating apparatus such as an infrared heater, a hot blast circulating furnace or an induction heating apparatus. Furthermore, the heat treatment may be conducted in one stage or in two or more stages. The heat treatment temperature is suitably from 180° to 240° C. The heat treatment time is generally from 1 to 10 minutes.

The container after heat treatment may be abruptly cooled or may be left standing to cool. More specifically, in the case of a film or a laminate sheet, an abrupt cooling operation is easy. However, in the case of a container, the abrupt cooling operation on an industrial scale is difficult because the container has a three dimensional shape and a large heat capacity. However, in the present invention, even if an abrupt cooling operation is not applied, the crystal growth is suppressed and excellent properties can be achieved in combination. An abrupt cooling means such as cold air blowing or cold water sprinkling may be used, if desired.

The can thus obtained may be subjected, if desired, to one-stage or multi-stage neck-in working and to flange working to produce a can for double seaming.

The present invention is described in greater detail below with reference to the following Examples.

The characteristic values reported herein were determined according to the following measuring methods.

(1) X-ray Diffraction

The X-ray diffraction was measured using a micro X-ray diffraction apparatus manufactured by Rigaku Denki KK under the following conditions:

| | |
|---|---|
| X ray: | CuKα X ray (1.542 Å) |
| Lamp voltage: | 40 KV |
| Tube current | 200 mA |
| X-ray beam size: | 100 μmϕ |
| Detector: | Position sensitive plunge counter |

The metal sheet was cut out on the axis line in a direction perpendicular to the rolled direction. For sampling a can side wall portion, the metal sheet was cut into 20 $mm^2$ pieces centered at a can height of 80 mm. For sampling a flange portion, the metal sheet was cut into 20 $mm^2$ pieces centered at a position 10 mm from the tip of the flange portion. The metal sheet of each cut-out sample was dissolved in 50% hydrochloric acid, and the film was isolated from the sheet and dried under vacuum for 24 hours. Then, each of the film strips thus obtained was cut out on an axis line in a direction perpendicular to the metal rolled direction for sampling the can side wall portion, that is, 10 mm in the can axis direction and 1 mm in the can circumference direction centered at a can height of 80 mm. Six pieces of film were superposed in parallel with each other in the can length direction to prepare a sample. For the flange portion, each of the film strips thus obtained was cut 5 mm in the can length direction from the tip of the flange portion and 1 mm in the can circumference direction. Six pieces of film were superposed in the same manner as described above to prepare a sample.

An X-ray beam was applied to the sample surface at a right angle as shown in FIG. 1 to conduct X-ray diffractometry. An example of the X-ray diffraction chart thus obtained is shown in FIG. 3, and the X-ray diffraction chart after base-line correction is shown in FIG. 4 including the peak intensities A and B and the half width Wh.

(2) Birefringence

The metal sheet was cut on an axis line in a direction perpendicular to the rolled direction into 5 $mm^2$ pieces. For sampling a side wall portion of the can barrel, the metal sheet was cut into pieces centered at a can height of 80 mm. For sampling the can bottom portion, the metal sheet was cut into pieces centered at the center part of the can bottom. For sampling the flange portion, the metal sheet was cut into pieces centered at a point 5 mm from the tip of the flange portion. The metal sheet of each sample thus obtained was dissolved in 50% hydrochloric acid. The remaining film was then isolated and then dried under vacuum for at least 24 hours to obtain a sample.

The film on the can side wall portion, on the can bottom portion or on the flange portion was wrapped and buried in an epoxy resin at a predetermined position. A cut of 3 μm was made parallel to the thickness direction (corresponding to $n_t$), to the lengthwise direction of the can (corresponding to $n_h$) and to the maximum orientation on the biaxially orientated face (corresponding to $n_m$). The retardation was measured through a polarization microscope, and the birefringence was determined as an average of values at five points in the cross section. An average birefringence was used for $\Delta n_1$, $\Delta n_4$, $\Delta n_5$ and $\Delta n_7$ including birefringences in the thickness direction. In the case of $\Delta n_1$ and $\Delta n_5$, the measurement was made down to 2 μm from the film front surface side and, in the case of $\Delta n_4$ and $\Delta n_7$, up to 2 μm from the metal side of the film. A wavelength of 546 nm was used for this measurement.

(3) Storage Test

A steel rod having a diameter of 65.5 mm was placed directly under the neck portion of a can disposed on an axis line perpendicular to the rolled direction of the metal sheet. A weight of 1 kg was dropped from a height of 60 mm to impact the can filled with cola at 5° C. Furthermore, the can was dropped from a height of 30 cm while leaning the can axis at 15° to impact the can. Thereafter, the can was subjected to a storage test at a temperature of 37° C. and the state of the can after one year of storage was examined. The negative pressure cans in Examples 6 and 7 each was filled with milk coffee. After retort sterilization at 125° C. for 30 minutes, the cans were impacted in the same manner as described above, and followed by storage testing.

EXAMPLE 1

A copolyester (Tm=228° C.) prepared from terephthalic acid/isophthalic acid (88/12 by weight) and ethylene glycol was drawn at 120° C. to 3.0 times in the longitudinal direction and to 3.0 times in the transverse direction, and then heat-fixed at 180° C. to obtain a biaxially stretched film having a thickness of 25 μm. Thereafter, on both surfaces of a tin-free steel (TFS) sheet having a blank thickness of 0.18 mm and a tempering degree of DR-6, the biaxially stretched film was heat-laminated at a sheet temperature of 240° C., a laminate roller temperature of 150° C. and a sheet traveling rate of 40 m/min. Immediately thereafter, the sheet was cooled with water to obtain a laminated metal sheet. A wax-based lubricating agent was applied to the coated metal sheet, and the metal sheet was punched into a disk having a diameter of 166 mm to obtain a shallow-drawn cup.

Thereafter, the resulting shallow-drawn cup was redrawn and ironed to obtain a deep-drawn and ironed cup having a structure as shown in FIG. 19. The deep-drawn cup thus obtained had the following properties:

| | |
|---|---|
| Cup size | 66 mm |
| Cup height | 128 mm |
| Thickness of can side wall portion to blank thickness | 65% |
| Thickness of flange portion to blank thickness | 77% |

The ironing ratio was 12%.

The resulting deep-drawn and ironed cup was domed in a customary manner, and then heat treated at 215° C. After being left to cool, the cup was trimmed at its open edge portion, printed on the curved surface, dried to complete the printing step and flanged to obtain a 350 g-volume seamless can. The can was then filled with cola and after storage impact testing, the state of inner surface of the can and the extent of leakage were examined. The film characteristic values of the can body and the evaluation results are shown in Table 2, which reveals that the seamless can thus obtained provided excellent shock resistance (dent resistance), corrosion resistance, and double seaming and sealing properties.

EXAMPLE 2

An epoxy phenol-base adhesive primer was coated on one surface of the biaxially stretched film of Example 1 in a coated amount expressed as a solid content of 10 mg/dm$^2$, and this coating was dried at 60° C. On both surfaces of a TFS sheet having a blank thickness of 0.175 mm and a tempering degree of DR-6, the above-described biaxially stretched film was fed so that the TFS sheet came into contact with the adhesive primer. The members were heat-laminated and then immediately cooled with water to obtain a coated metal sheet. A seamless can was produced in the same manner as in Example 1 except for using the coated metal sheet obtained as described above and having a structure as shown in FIG. 18.

The film characteristic values of the can body and the evaluation results are shown in Table 2. These results show that the seamless can thus obtained exhibited excellent shock resistance (dent resistance), corrosion resistance and double seaming and sealing properties.

EXAMPLE 3

A copolyester (Tm=248° C.) prepared from terephthalic acid/isophthalic acid (97/3 by weight) and ethylene glycol was drawn at 120° C. to 3.0 times in the longitudinal direction and to 3.0 times in the -transverse direction, and then heat-fixed at 180° C. to obtain a biaxially stretched film having a thickness of 25 μm. Thereafter, the biaxially stretched film was heat-laminated in the same manner as in Example 1, except for setting the sheet temperature at heat laminating to 258° C., the laminate roller temperature to 150° C. and the sheet traveling rate to 60 m/min to obtain a laminated metal sheet. The resulting coated metal sheet was punched into a disk having a diameter of 163 mm. A cup was produced therefrom by deep-drawing and ironing in the same manner as in Example 1, except that the thickness of the can side wall portion to the blank thickness was 60% and the ironing ratio was 17%. A seamless can was obtained using the resulting deep-drawn and ironed cup in the same manner as in Example 1, except that the heat treatment was conducted at 235° C.

The film characteristic values of the can body and the evaluation results are shown in Table 2. The results show that the seamless can thus obtained exhibited excellent shock resistance (dent resistance), corrosion resistance and double seaming and sealing properties.

EXAMPLE 4

A laminate consisting of a copolyester (Tm=228° C.) as polyester layer A prepared from terephthalic acid/isophthalic acid (88/12 by weight) and ethylene glycol, and a polyester (Tm=236° C.) as polyester layer B obtained by blending a copolymer prepared from terephthalic acid/isophthalic acid (94/6 by weight) and ethylene glycol with polybutylene terephthalate at a weight ratio of 70/30 was drawn at 120° C. to 3.0 times in the longitudinal direction and to 3.1 times in the transverse direction and then heat-fixed at 180° C. to obtain a biaxially stretched film. In the laminate film, polyester layer A had a thickness of 4 μm, polyester layer B had a thickness of 16 μm and the total thickness was 20 μm. Thereafter, the laminate film was heat-laminated so that polyester film layer B came into contact with the metal sheet. A seamless can was then produced therefrom in the same manner as in Example 1, except for carrying out the heat treatment of the deep-drawn and ironed cup at 220° C.

The film characteristic values of the can body and the evaluation results are shown in Table 2. The results show that the seamless can thus obtained exhibited excellent shock resistance (dent resistance), corrosion resistance and double seaming and sealing properties.

EXAMPLE 5

A deep-drawn and ironed cup was obtained in the same manner as in Example 1, except that a blank having a thickness of 0.190 mm and a biaxially stretched polyethylene terephthalate film (stretching magnification: 3.3×3.3, heat-fixing temperature: 180° C., Tm=255° C., thickness: 25 μm) were used. The heat-laminating was conducted at a sheet temperature of 263° C., a laminating roller temperature of 160° C. and a sheet traveling rate of 100 m/min. The thickness of the side wall portion of the can to the blank thickness was 50% and the ironing ratio was 20%.

A seamless can was obtained in the same manner as in Example 1, except that the resulting deep-drawn and ironed cup was heat-treated at 245° C.

The film characteristic values of the can body and the evaluation results are shown in Table 2. The results show that the seamless can thus obtained exhibited excellent shock resistance (dent resistance), corrosion resistance and double seaming and sealing properties.

EXAMPLE 6

A laminate metal sheet was obtained in the same manner as in Example 1 using a blank having a thickness of 0.215 mm and the biaxially stretched film of Example 1. The resulting metal sheet was punched into a disk having a diameter of 143 mm to obtain a shallow-drawn cup. Then, the cup was subjected to a reduction in thickness and redrawing-ironing working to have the structure shown in FIG. 17.

The thus-obtained deep-drawn and ironed cup had the following properties:

| | |
|---|---|
| Cup size | 52 mm |
| Cup height | 110 mm |
| Thickness of can side wall portion to blank thickness | 73% |
| Thickness of flange portion to blank thickness | 78% |

The ironing ratio was 13%.

The resulting deep-drawn and ironed cup was domed for a negative pressure can, and a 200 g-volume seamless can was obtained therefrom in the same manner as in Example 1.

The film characteristic values of the can body and the evaluation results are shown in Table 2. The results show that the seamless can thus obtained exhibited excellent shock resistance (dent resistance), corrosion resistance and double seaming and sealing properties.

EXAMPLE 7

The laminated metal sheet used in Example 6 was punched into a disk having a diameter of 162 mm to obtain a shallow-drawn cup. Then, the resulting cup was subjected to a reduction in thickness and redrawing-ironing working to obtain a deep-drawn and ironed cup.

The thus-obtained deep-drawn and ironed cup had the following properties:

| | |
|---|---|
| Cup size | 52 mm |
| Cup height | 135 mm |
| Thickness of can side wall portion to blank thickness | 80% |
| Thickness of flange portion to blank thickness | 83% |

The ironing ratio was 10%.

Using the resulting deep-drawn and ironed cup, a 250 g-volume seamless can was obtained in the same manner as in Example 1.

The film characteristic values of the can body and the evaluation results are shown in Table 2. The results show that the seamless can thus obtained exhibited excellent shock resistance (dent resistance), corrosion resistance and double seaming and sealing properties.

EXAMPLE 8

The laminated metal sheet used in Example 1 was punched into a disk having a diameter of 179 mm, and the disk was formed into a shallow-drawn cup. Then, the cup was subjected to a reduction in thickness and redrawing working. A 350 g-volume seamless can was obtained in the same manner as in Example 1, except that the side wall thickness was 80% of the blank thickness.

The film characteristic values and the evaluation results are shown in Table 2. The can thus obtained exhibited underfilm corrosion in the periphery of the dented part at the neck portion after storage aging, and the can was unsuitable for use as a container.

EXAMPLE 9

The biaxially stretched film of Example 1 was heat-laminated at a sheet temperature of 260° C., a laminate roller temperature of 90° C. and a sheet traveling rate of 10 m/min. A formed cup was obtained in the same manner as in Example 1, and was subsequently heat-treated at 235° C. for 3 minutes. Then, a seamless can was obtained in the same manner as in Example 1.

The film characteristic values and the evaluation results are shown in Table 2. The can thus obtained exhibited film cracks and corrosion of the metal sheet in the peripheral part of the neck portion after storage aging, and the can was considered to be unsuitable for practical use.

EXAMPLE 10

On both surfaces of a tin-free steel (TFS) sheet having a blank thickness of 0.210 mm, an amorphous (unstretched) polyester film having a thickness of 40 μm (polyethylene terephthalate, Tm=255° C.) was heat laminated at a sheet temperature of 270° C., a laminate roller temperature of 90° C. and a sheet traveling rate of 5 m/min. Immediately thereafter, the sheet was cooled with water to obtain a laminated metal sheet. The resulting coated metal sheet was punched into a disk having a diameter of 163 mm. A seamless can was obtained in the same manner as in Example 1, except that the thickness of the side wall portion of the can to the blank thickness was 50% and the ironing ratio was 30%.

The film characteristic values and the evaluation results are shown in Table 2. The can exhibited film cracks and considerable corrosion of the metal sheet in the periphery of the dented part at the neck portion, in the periphery of the double seam portion and in the periphery of the can bottom portion. Thus, the can was not suitable for practical use.

EXAMPLE 11

A seamless can was obtained in the same manner as in Example 1, except that the biaxially stretched and heat-laminated film of Example 1 was further heated at 250° C. for 2 minutes and then abruptly cooled to obtain a laminated metal sheet.

The film characteristic values and the evaluation results are shown in Table 2. After storage aging, the can exhibited film cracks and considerable corrosion of the metal sheet in the periphery of the dented part at the neck portion, in the periphery of the double seam portion and in the periphery of the can bottom portion. Thus, the can was unsuitable for practical use.

EXAMPLE 12

A seamless can was obtained in the same manner as in Example 1 using the laminated metal sheet of Example 1, except that an ironing ratio of 2% was used in reducing thickness and in the redrawing-ironing formation for obtaining a cup.

The film characteristic values and the evaluation results are shown in Table 2. After storage aging, the can exhibited underfilm corrosion in the periphery of the neck portion and the double seam portion, and the can was unsuitable for use as a container.

EXAMPLE 13

A laminated metal sheet was obtained in the same manner as in Example 5, except that the biaxially stretched film having a thickness of 20 μm was heat-laminated at a sheet temperature of 235° C., a laminate roller temperature of 110° C. and a sheet traveling rate of 100 m/min. Furthermore, a seamless can was obtained in the same manner as in Example 1.

The film characteristic values and the evaluation results are shown in Table 2. The can exhibited film breakage and extensive delamination at the upper portion of the can and was judged to be unsuitable for practical use.

$$D1 = \frac{B}{A} \times 100 \quad (1)$$

wherein A represents a peak intensity at 2θ of approximately from 24° to 29° in a corrected X-ray diffraction curve which is obtained by peeling a plurality of films from the side wall portion of a can, superposing the films in parallel with one another in the height direction of the can, applying an X ray (Cu-Kα) to enter the film surface perpendicular to the height

TABLE 2

| | Property of Can Side Wall Portion | | | | | | Property of Can Bottom Portion | | | Property of Flange Portion | | | | | | |
|---|---|---|---|---|---|---|---|---|---|---|---|---|---|---|---|---|
| Example | D1 | Wh | $\Delta n_1$ | $\Delta n_2$ | $\Delta n_3$ | $\Delta n_4$ | $\Delta n_5$ | $\Delta n_6$ | $\Delta n_7$ | D1 | Wh | $\Delta n_1$ | $\Delta n_2$ | $\Delta n_3$ | $\Delta n_4$ | Storage Test |
| 1 | 100 | 1.1 | 0.120 | 0.140 | 0.090 | 0.030 | 0.065 | 0.070 | 0.004 | 50 | 1.1 | 0.100 | 0.110 | 0.090 | 0.050 | no abnormality |
| 2 | 100 | 1.1 | 0.120 | 0.140 | 0.090 | 0.030 | 0.065 | 0.070 | 0.004 | 50 | 1.1 | 0.100 | 0.110 | 0.090 | 0.050 | no abnormality |
| 3 | 197 | 1.1 | 0.140 | 0.160 | 0.150 | 0.040 | 0.060 | 0.065 | 0.010 | 56 | 1.1 | 0.120 | 0.140 | 0.140 | 0.020 | no abnormality |
| 4 | 188 | 1.0 | 0.090 | 0.190 | 0.180 | 0.070 | 0.070 | 0.100 | 0.010 | 99 | 1.0 | 0.085 | 0.170 | 0.170 | 0.050 | no abnormality |
| 5 | 70 | 1.25 | 0.145 | 0.150 | 0.115 | 0.080 | 0.055 | 0.062 | 0.016 | 26 | 1.1 | 0.097 | 0.110 | 0.080 | 0.040 | no abnormality |
| 6 | 75 | 1.1 | 0.150 | 0.155 | 0.120 | 0.070 | 0.065 | 0.070 | 0.004 | 69 | 1.0 | 0.150 | 0.155 | 0.140 | 0.075 | no abnormality |
| 7 | 78 | 1.0 | 0.145 | 0.150 | 0.140 | 0.085 | 0.065 | 0.070 | 0.004 | 70 | 1.1 | 0.130 | 0.160 | 0.130 | 0.060 | no abnormality |
| 8 | 56 | 0.9 | 0.120 | 0.140 | 0.140 | 0.020 | 0.065 | 0.070 | 0.004 | 55 | 1.1 | 0.140 | 0.160 | 0.160 | 0.50 | extensive corrosion in the periphery of neck portion |
| 9 | 170 | 2.1 | 0.02 | — | — | 0.000 | 0.020 | — | — | 160 | 2.5 | 0.01 | — | — | 0.000 | extensive corrosion in the periphery of neck portion |
| 10 | 163 | 1.9 | 0.140 | 0.110 | — | 0.060 | 0.000 | — | 0.002 | 150 | 2.1 | 0.110 | 0.060 | — | 0.025 | extensive corrosion in the periphery of neck and double seam portions |
| 11 | 150 | 1.9 | 0.05 | — | — | 0.002 | 0.020 | — | 0.000 | 140 | 2.3 | 0.050 | — | — | 0.000 | extensive corrosion in the periphery of can bottom, neck and double seam portions |
| 12 | 75 | 0.95 | 0.135 | 0.170 | 0.150 | 0.130 | 0.065 | 0.070 | 0.004 | 70 | 1.0 | 0.130 | 0.160 | 0.150 | 0.150 | extensive corrosion in the periphery of neck and double seam portions |
| 13 | 80 | 1.2 | 0.16 | 0.19 | 0.20 | 0.160 | 0.150 | 0.160 | 0.120 | 100 | 1.0 | 0.170 | 0.180 | 0.20 | 0.155 | not conducted |

In accordance with the present invention, in the drawing/redrawing working of a polyester coated metal sheet, the side wall portion of the can barrel is subjected to bend-elongation and at the same time to ironing under specific conditions, to thereby advantageously modify the molecular orientation of the polyester film on the side wall portion. As a result, shock resistance (dent resistance), corrosion resistance, and double seaming and sealing properties after heat treatment of the polyester are remarkably improved. Also, the cost for materials as well as the container weight can be reduced.

While the invention has been described in detail and with reference to specific embodiments thereof, it will be apparent to one skilled in the art that various changes and modifications can be made therein without departing from the spirit and scope thereof.

What is claimed is:

1. A thin-walled, deep-draw-ironed seamless can having a side wall portion, a bottom portion and a flange portion and comprising a laminate of a metal sheet and a biaxially stretched film of polyester or copolyester mainly comprising an ethylene terephthalate unit, wherein the thickness of the side wall portion of the can has been reduced to from 30 to 85% of the original thickness of the laminate, and the film layer on said side wall portion of the can has a parallel component orientation (D1) defined by the following formula (1) of 65% or more and a half width (Wh) of the peak at a diffraction angle 2θ of approximately from 14° to 20° falling within 1.8°:

direction of the can, varying the angle of diffraction (2θ) within the surface including the incident X ray and perpendicular to said height direction to obtain an X-ray diffraction curve and, in the X-ray diffraction curve thus obtained, drawing a base line connecting troughs and feet between peaks in the range of 2θ of from 10° to 60° to obtain a corrected X-ray diffraction curve; and B represents an intensity from the base line in the range of 2θ of approximately from 14° to 20° in said corrected X-ray diffraction curve.

2. The seamless can as claimed in claim 1, wherein the birefringence (Δn) of the polyester or copolyester film having a front surface side and a metal sheet side on the side wall portion of the can barrel as determined by a birefringence method and defined by the following formula (2) is from 0.020 to 0.180 on the front surface side ($\Delta n_1$) and from 0.005 to 0.120 on the side in contact with the metal sheet ($\Delta n_4$), at least two or more birefringence peaks are present along the thickness direction from the front surface side to the metal sheet side, a birefringence peak ($P_1$)($\Delta n_2$) is present in the vicinity of the front surface side and a birefringence peak ($P_2$)($\Delta n_3$) is present in the vicinity of the metal sheet side, the birefringence peak ($P_1$)($\Delta n_2$) in the vicinity of the front surface side is from 0.020 to 0.220 and at least 0.005 higher than the birefringence of the higher side of the foot of the peak, and the birefringence peak ($P_2$)($\Delta n_3$) in the vicinity of the metal sheet side is from 0.010 to 0.200 and at least 0.005 higher than the birefringence of the higher side of the foot of the peak:

$$\Delta n_{1-4} = n_h - n_r \quad (2)$$

wherein $n_h$ is a refractive index of the film in the lengthwise direction of the can and $n_t$ is a refractive index in the thickness direction of the film.

3. The seamless can as claimed in claim 1, wherein the birefringence ($\Delta n$) of the polyester or copolyester film having a front surface side and a metal sheet side on the can bottom portion as determined by a birefringence method and defined by the following formula (3) is from 0.020 to 0.140 on the front surface side ($\Delta n_5$) and from 0.005 to 0.100 on the side in contact with the metal sheet ($\Delta n_7$), at least one birefringence peak is present along the thickness direction ($\Delta n_6$) from the front surface side to the metal sheet side, and the birefringence ($\Delta n_6$) peak along the thickness direction is from 0.020 to 0.160 and at least 0.005 higher than the birefringence of the higher side of the foot of the peak:

$$\Delta n_{5-7}=n_m-n_t \quad (3)$$

wherein $n_m$ is a refractive index in the direction of maximum orientation of the film and $n_t$ is a refractive index in the thickness direction of the film.

4. The seamless can as claimed in claim 1, wherein the parallel component orientation (D1) of the flange portion at the upper end on the side wall portion of the can defined by formula (1) is 10% or more, and the half width (Wh) of the peak at a diffraction angle 2θ of approximately from 14° to 20° falls within 1.8°.

5. The seamless can as claimed in claim 2, wherein the parallel component orientation (D1) of the flange portion at the upper end on the side wall portion of the can defined by formula (1) is 10% or more, and the half width (Wh) of the peak at a diffraction angle 2θ of approximately from 14° to 20° falls within 1.8°.

6. The seamless can as claimed in claim 3, wherein the parallel component orientation (D1) of the flange portion at the upper end on the side wall portion of the can defined by formula (1) is 10% or more, and the half width (Wh) of the peak at a diffraction angle 2θ of approximately from 14° to 20° falls within 1.8°.

7. The seamless can as claimed in claim 4, wherein the birefringence ($\Delta n$) of the polyester or copolyester film having a front surface side and a metal sheet side on said flange portion as determined by a birefringence method and defined by the following formula (2) is from 0.020 to 0.180 on the front surface side ($\Delta n_1$) and from 0.005 to 0.100 on the side in contact with the metal sheet ($\Delta n_4$), at least two birefringence peaks are present along the thickness direction from the front surface side to the metal sheet side, a birefringence peak ($P_1$)($\Delta n_2$) is present in the vicinity of the front surface side and a birefringence peak ($P_2$)($\Delta n_3$) is present in the vicinity of the metal sheet side, the birefringence peak ($P_1$)($\Delta n_2$) in the vicinity of the front surface side is from 0.020 to 0.220 and at least 0.005 higher than the birefringence of the higher side of the foot of the peak, and the birefringence peak ($P_2$)($\Delta n_3$) in the vicinity of the metal sheet side is from 0.010 to 0.200 and at least 0.005 higher than the birefringence of the higher side of the foot of the peak:

$$\Delta n_{1-4}=n_h-n_t \quad (2)$$

wherein $n_h$ is a refractive index of the film in the lengthwise direction of the can and $n_t$ is a refractive index in the thickness direction of the film.

8. The seamless can as claimed in claim 5, wherein the birefringence ($\Delta n$) of the polyester or copolyester film having a front surface side and a metal sheet side on said flange portion as determined by a birefringence method and defined by the following formula (2) is from 0.020 to 0.180 on the front surface side ($\Delta n_1$) and from 0.005 to 0.100 on the side in contact with the metal sheet ($\Delta n_4$), at least two birefringence peaks are present along the thickness direction from the front surface side to the metal sheet side, a birefringence peak ($P_1$)($\Delta n_2$) is present in the vicinity of the front surface side and a birefringence peak ($P_2$)($\Delta n_3$) is present in the vicinity of the metal sheet side, the birefringence peak ($P_1$)($\Delta n_2$) in the vicinity of the front surface side is from 0.020 to 0.220 and at least 0.005 higher than the birefringence of the higher side of the foot of the peak, and the birefringence peak ($P_2$)($\Delta n_3$) in the vicinity of the metal sheet side is from 0.010 to 0.200 and at least 0.005 higher than the birefringence of the higher side of the foot of the peak:

$$\Delta n_{1-4}=n_h-n_t \quad (2)$$

wherein $n_h$ is a refractive index of the film in the lengthwise direction of the can and $n_t$ is a refractive index in the thickness direction of the film.

9. The seamless can as claimed in claim 6, wherein the birefringence ($\Delta n$) of the polyester or copolyester film having a front surface side and a metal sheet side on said flange portion as determined by a birefringence method and defined by the following formula (2) is from 0.020 to 0.180 on the front surface side ($\Delta n_1$) and from 0.005 to 0.100 on the side in contact with the metal sheet ($\Delta n_4$), at least two birefringence peaks are present along the thickness direction from the front surface side to the metal sheet side, a birefringence peak ($P_1$)($\Delta n_2$) is present in the vicinity of the front surface side and a birefringence peak ($P_2$)($\Delta n_3$) is present in the vicinity of the metal sheet side, the birefringence peak ($P_1$)($\Delta n_2$) in the vicinity of the front surface side is from 0.020 to 0.220 and at least 0.005 higher than the birefringence of the higher side of the foot of the peak, and the birefringence peak ($P_2$)($\Delta n_3$) in the vicinity of the metal sheet side is from 0.010 to 0.200 and at least 0.005 higher than the birefringence of the higher side of the foot of the peak:

$$\Delta n_{1-4}=n_h-n_t \quad (2)$$

wherein $n_h$ is a refractive index of the film in the lengthwise direction of the can and $n_t$ is a refractive index in the thickness direction of the film.

10. The seamless can as claimed in claim 1, wherein the half width (Wh) of the peak at a diffraction angle 2θ of approximately from 14° to 20° falls within 1.4°.

11. The seamless can as claimed in claim 1, wherein the film layer on the side wall portion of the can has a parallel component orientation (D1) of 75% or more.

12. The seamless can as claimed in claim 1, wherein the polyester or copolyester film comprises an ethylene terephthalate unit in an amount of 80 mol % or higher.

13. The seamless can as claimed in claim 1, wherein the metal sheet of the laminate comprises a steel plate treated with electrolytic chromic acid, or an aluminum plate or an aluminum alloy plate.

14. The seamless can as claimed in claim 1, wherein the polyester or copolyester film has a thickness of from 2 to 100 μm.

15. The seamless can as claimed in claim 1, wherein the laminate further comprises an adhesive primer disposed between the metal sheet and the polyester or copolyester film.

16. The seamless can as claimed in claim 4, wherein the ratio of the thickness of the flange portion to the thickness of the side wall portion is from 1.0 to 2.0.

17. The seamless can as claimed in claim 16, wherein the flange portion is thicker than the side wall portion.

18. The seamless can as claimed in claim 1, wherein the can has been heat-treated in one or more stages at a temperature of from 180° to 240° C. for a time of from 1 to 10 minutes.

* * * * *